US006208124B1

(12) United States Patent
Fuchigami et al.

(10) Patent No.: US 6,208,124 B1
(45) Date of Patent: Mar. 27, 2001

(54) SEMICONDUCTOR INTEGRATED CIRCUIT

(75) Inventors: Ikuo Fuchigami; Tomonori Kataoka; Youichi Nishida; Tomoo Kimura, all of Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/586,993

(22) Filed: Jun. 5, 2000

(30) Foreign Application Priority Data

Jun. 4, 1999 (JP) ..... 11-158096

(51) Int. Cl.[7] ..... G05F 1/40
(52) U.S. Cl. ..... 323/281; 323/274; 307/11
(58) Field of Search ..... 323/274, 281, 323/280, 901, 267; 307/31, 11

(56) References Cited

U.S. PATENT DOCUMENTS 5,747,974 * 5/1998 Jeon ..... 323/281
6,046,577 * 4/2000 Rincon-Mora et al. ..... 323/281
6,114,845 * 9/2000 Capici et al. ..... 323/281

FOREIGN PATENT DOCUMENTS 10-133754 5/1998 (JP) .

* cited by examiner

*Primary Examiner*—Shawn Riley
(74) *Attorney, Agent, or Firm*—Wenderoth, Lind & Ponack, L.L.P.

(57) ABSTRACT

A semiconductor integrated circuit includes a booster for boosting a power supply voltage, and outputting the boosted voltage; an output circuit being supplied with the boosted voltage, and generating an output voltage from the boosted voltage; a reference voltage generator being supplied with the power supply voltage, and generating a reference voltage from the power supply voltage; a voltage divider being supplied with the output voltage from the output circuit, and dividing the output voltage with a predetermined voltage ratio; and a differential amplifier being supplied with the reference voltage and the divided voltage, and controlling the output circuit by supplying the output circuit with a voltage obtained by performing differential amplification on the reference voltage and the divided voltage according to the power supply voltage, thereby maintaining the output voltage from the output circuit at a predetermined voltage. In this circuit, since the reference voltage generator and the differential amplifier are operated with the power supply voltage, it is not necessary to supply the boosted voltage to them, whereby the output current from the booster is reduced. Therefore, undesired reduction in the boosted voltage due to an increase in the output current is suppressed. As the result, the capacitance used in the booster is reduced, and the area of the semiconductor integrated circuit is reduced.

28 Claims, 20 Drawing Sheets

SEMICONDUCTOR INTEGRATED CIRCUIT

FIELD OF THE INVENTION

The present invention relates to semiconductor integrated circuits and, more particularly, to a semiconductor integrated circuit which performs voltage regulation for a boosting power supply circuit or a negative boosting power supply circuit.

BACKGROUND OF THE INVENTION

In recent years, low voltage and single power supply have been required of a flash memory as a nonvolatile semiconductor memory device and, therefore, there is a demand for a semiconductor integrated circuit which performs boosting or negative boosting on chip to supply voltages required for writing, erasing, and the like.

FIG. 26 is a block diagram illustrating a conventional semiconductor integrated circuit (hereinafter referred to as a semiconductor IC).

With reference to FIG. 26, the semiconductor IC comprises a booster 201 and a regulator 202. The booster 201 boosts a power supply voltage $V_{DD}$ applied to this semiconductor IC, to a predetermined voltage $V_{PP}$. The regulator 202 is supplies with the boosted voltage $V_{PP}$, and regulates the boosted voltage $V_{PP}$ to output an output voltage Vo. The regulator 202 comprises a reference voltage generator 203, a differential amplifier 204, an output circuit 205, and a voltage divider 206.

The reference voltage generator 203 is supplied with the boosted voltage $V_{PP}$ from the booster 201, and generates a reference voltage Vref. The reference voltage generator 203 can change the reference voltage Vref to plural voltages. The differential amplifier 204 is supplied with the output voltage $V_{PP}$ from the booster 201 through a power input terminal and, further, it is supplied with the reference voltage Vref generated by the reference voltage generator 203 and a divided voltage Vd (described later) from the voltage divider 206. The differential amplifier performs differential amplification on the basis of the voltage $V_{PP}$, and outputs a voltage Va so obtained. The output circuit 205 includes a P type MOS transistor having a gate connected to the output terminal of the differential amplifier 204, a source connected to the output terminal of the booster 201, and a drain connected to the input terminal of the voltage divider 206. The output circuit 205 outputs, as an output voltage Vo from the regulator 202, a voltage obtained by regulating the output voltage $V_{PP}$ from the booster 201 on the basis of the output voltage Va from the differential amplifier 204. The voltage divider 206 is supplied with the output voltage Vo from the output circuit 205, and outputs a divided voltage Vd obtained by dividing the output voltage Vo.

Hereinafter, the operation of the conventional semiconductor IC so constructed will be described.

The booster 201 generates a boosted voltage $V_{PP}$ which is higher than the power supply voltage $V_{DD}$ from the power supply voltage $V_{DD}$, and outputs this voltage $V_{PP}$ to the regulator 202. The regulator 202 outputs a predetermined constant voltage Vo obtained by decreasing the boosted voltage $V_{PP}$, from its output terminal.

In the regulator 202, the reference voltage generator 203 is supplied with the boosted voltage $V_{PP}$, generates a predetermined reference voltage Vref, and outputs it. Accordingly, the reference voltage Vref has a value in a range from the boosted voltage $V_{PP}$ to a ground voltage $V_{SS}$. The voltage divider 206 outputs a divided voltage Vd which is obtained by dividing the output voltage Vo from the regulator 202, according to a predetermined voltage ratio r ($r \geqq 1$), so as to satisfy the relationship VO/Vd=r. The output voltage Vd from the voltage divider 206 is compared with the reference voltage Vref by the differential amplifier 204, and the P type MOS transistor M10 in the output circuit 205 is controlled by the output voltage Va from the differential amplifier 204, resulting in Vd=Vref. In this way, the regulator 202 is able to generate an output voltage Vo which is maintained at a constant voltage, i.e., Vo=r·Vref, from the boosted voltage $V_{PP}$ which is not always stable.

Further, the regulator 202 is required to provide different output voltages Vo for different modes of the nonvolatile semiconductor memory device, such as writing, erasing, etc. In this case, supply of voltages suited for different modes is realized by changing the reference voltage Vref for each mode.

Further, although a power supply circuit performing positive boosting has been described above, a conventional semiconductor IC for generating a negative voltage is similar to the above-described circuit. In this case, in the semiconductor IC shown in FIG. 26, the booster 201 is replaced with a negative booster, and the P type MOS transistor M10 in the output circuit 205 is replaced with an N type MOS transistor, whereby a semiconductor IC which is able to output a constant negative voltage with reference to a negative reference voltage is obtained.

In the conventional semiconductor IC, however, since the regulator 202 operates with the output voltage $V_{PP}$ from the booster 201, a great load is applied to the booster 201. Usually, the booster 201 is a charge pump circuit, and the output current vs. output voltage characteristics are as shown in FIG. 27.

FIG. 27 is a graph showing the output current $I_{PP}$ vs. output voltage $V_{PP}$ characteristics of the charge pump circuit. The abscissa indicates the output current $I_{PP}$, and the ordinate indicates the output voltage $V_{PP}$. As seen from the graph of FIG. 27, the output voltage $V_{PP}$ from the booster 201 decreases with an increase in the output current $I_{PP}$. Accordingly, when the load on the booster 201 increases, the output current $I_{PP}$ increases, resulting in difficulty in obtaining a predetermined output voltage $V_{PP}$. Especially, in order to secure a boosted voltage $V_{PP}$ higher than a predetermined level to achieve a reduced power supply voltage, the number of stages of the charge pump circuit must be increased, but this causes further increase in the reduction radio of the output voltage $V_{PP}$ to the output current $I_{PP}$. Therefore, the capacitance in the booster 201 must be increased to maintain the output voltage $V_{PP}$ from the booster 201 at a predetermined level, resulting in an increase in the area of the booster 201.

Likewise, also in the conventional semiconductor IC for generating a negative voltage, since the regulator operates with the output voltage from the negative booster, a great load is applied to the negative booster. Therefore, like the booster described above, the output current from the negative booster increases, and it becomes difficult for the negative booster to secure a predetermined output voltage. Also in this case, in order to secure the output voltage, the area of the negative booster must be increased to increase the capacitance in the negative booster.

SUMMARY OF THE INVENTION

The present invention is made to solve the above-described problems and has for its object to provide a semiconductor IC, the area of which can be reduced by reducing the scale of a booster or a negative booster.

Other objects and advantages of the invention will become apparent from the detailed description that follows. The detailed description and specific embodiments described are provided only for illustration since various additions and modifications within the scope of the invention will be apparent to those of skill in the art from the detailed description.

According to a first aspect of the present invention, there is provided a semiconductor integrated circuit comprising a booster for boosting a power supply voltage, and outputting the boosted voltage; an output circuit being supplied with the boosted voltage, generating an output voltage from the boosted voltage, and outputting the output voltage through an output terminal; a reference voltage generator being supplied with the power supply voltage, generating a reference voltage from the power supply voltage, and outputting the reference voltage; a voltage divider being supplied with the output voltage from the output circuit, dividing the output voltage with a predetermined voltage ratio, and outputting the divided voltage; and a differential amplifier being supplied with the reference voltage and the divided voltage, and controlling the output circuit by supplying the output circuit with a voltage which is obtained by performing differential amplification on the reference voltage and the divided voltage according to the power supply voltage, thereby maintaining the output voltage from the output circuit at a predetermined voltage.

According to a second aspect of the present invention, in the semiconductor integrated circuit of the first aspect, the voltage divider is a resistance type voltage divider having a plurality of resistors connected in series.

According to a third aspect of the present invention, in the semiconductor integrated circuit of the first aspect, the voltage divider comprises a plurality of diode-junction type transistors connected in series, each transistor having a gate and a drain connected to each other, and a source connected to a substrate.

According to a fourth aspect of the present invention, in the semiconductor integrated circuit of the first aspect, the voltage divider comprises a plurality of capacitors connected in series; and an initialization circuit performing initialization by short-circuiting the both ends of each capacitor.

According to a fifth aspect of the present invention, in the semiconductor integrated circuit of the first aspect, the voltage divider sets the voltage ratio at different values according to control signals.

According to a sixth aspect of the present invention, in the semiconductor integrated circuit of the fifth aspect, the voltage divider comprises a plurality of resistors connected in series between the output terminal of the output circuit and the ground voltage; at least one transistor having an end connected to any of the nodes between the plural resistors, and the other end connected to the output terminal of the output circuit; a control circuit being supplied with the control signal, and giving a control voltage based on the control signal to a control end of the transistor; and an output terminal for taking out the divided voltage, connected to any of the nodes between the plural resistors.

According to a seventh aspect of the present invention, in the semiconductor integrated circuit of the fifth aspect, the voltage divider comprises a plurality of diode-junction type transistors connected in series between the output terminal of the output circuit and the ground voltage, each transistor having a gate and a drain connected to each other, and a source connected to a substrate; at least one transistor for voltage control, having an end connected to any of the nodes between the plural transistors, and the other end connected to the output terminal of the output circuit; a control circuit being supplied with the control signal, and giving a control voltage based on the control signal to a control end of the transistor for voltage control; and an output terminal for taking out the divided voltage, connected to any of the nodes between the plural transistors.

According to an eighth aspect of the present invention, in the semiconductor integrated circuit of the fifth aspect, the voltage divider comprises a plurality of capacitors connected in series between the output terminal of the output circuit and the ground voltage; at least one transistor having an end connected to any of the nodes between the plural capacitors, and the other end connected to the output terminal of the output circuit; a control circuit being supplied with the control signal, and giving a control voltage based on the control signal to a control end of the transistor; an initialization circuit performing initialization by short-circuiting the both ends of each capacitor; and an output terminal for taking out the divided voltage, connected to any of the nodes between the plural capacitors.

According to a ninth aspect of the present invention, in the semiconductor integrated circuit of the fifth aspect, the voltage divider comprises two first capacitors connected in series between the output terminal of the output circuit and the ground voltage; at least one transistor having an end connected to a node between the first capacitors; at least one second capacitor, as many as the transistor, having an end connected to the transistor, and the other end being grounded; a control circuit being supplied with the control signal, and giving a control voltage based on the control signal to a control end of the transistor; an initialization circuit for initializing the node between the first capacitors; and an output terminal for taking out the divided voltage, connected to the node between the first capacitors.

According to a tenth aspect of the present invention, in the semiconductor integrated circuit of the first aspect, the output circuit comprises a first P type MOS transistor having a gate, a source connected to the output terminal of the booster, and a drain connected to the output terminal of the output circuit; a second P type MOS transistor having a gate, a source connected to the output terminal of the booster, and a drain connected to the gate of the first P type MOS transistor; an N type MOS transistor having a source being grounded, a drain connected to the drain of the second P type MOS transistor, and a gate connected to the output terminal of the differential amplifier; and a bias circuit for giving a bias voltage to the gate of the second P type MOS transistor.

According to an eleventh aspect of the present invention, in the semiconductor integrated circuit of the first aspect, the output circuit comprises a first P type MOS transistor having a gate, a source connected to the output terminal of the booster, and a drain connected to the output terminal of the output circuit; a second P type MOS transistor having a source connected to the output terminal of the booster, and a gate and a drain connected to the gate of the first P type MOS transistor; and an N type MOS transistor having a source being grounded, a drain connected to the drain of the second P type MOS transistor, and a gate connected to the output terminal of the differential amplifier.

According to a twelfth aspect of the present invention, in the semiconductor integrated circuit of the first aspect, the output circuit comprises a first P type MOS transistor having a gate, a source connected to the output terminal of the booster, and a drain connected to the output terminal of the output circuit; a second P type MOS transistor having a source connected to the output terminal of the booster, a drain connected to the gate of the first P type MOS transistor, and a gate being grounded; and an N type MOS transistor having a source being grounded, a drain connected to the drain of the second P type MOS transistor, and a gate connected to the output terminal of the differential amplifier.

According to a thirteenth aspect of the present invention, there is provided a semiconductor integrated circuit comprising a negative booster for generating a negative voltage from a power supply voltage, and outputting the negative voltage; an output circuit being supplied with the negative voltage, generating an output voltage from the negative voltage, and outputting the output voltage through an output terminal; a reference voltage generator being supplied with the power supply voltage, generating a reference voltage from the power supply voltage, and outputting the reference voltage; a voltage divider being supplied with the output voltage from the output circuit and the reference voltage, dividing a potential difference between the output voltage and the reference voltage according to a predetermined voltage ratio, and outputting the divided voltage; and a differential amplifier being supplied with the divided voltage and a ground voltage, and controlling the output circuit by supplying the output circuit with a voltage which is obtained by performing differential amplification on the divided voltage and the ground voltage according to the power supply voltage, thereby maintaining the output voltage from the output circuit at a predetermined voltage.

According to a fourteenth aspect of the present invention, in the semiconductor integrated circuit of the thirteenth aspect, the voltage divider is a resistance type voltage divider having a plurality of resistors connected in series.

According to a fifteenth aspect of the present invention, in the semiconductor integrated circuit of the thirteenth aspect, the voltage divider comprises a plurality of diode-junction type transistors connected in series, each transistor having a gate and a drain connected to each other, and a source connected to a substrate.

According to a sixteenth aspect of the present invention, in the semiconductor integrated circuit of the thirteenth aspect, the voltage divider comprises a plurality of capacitors connected in series; and an initialization circuit performing initialization by short-circuiting the both ends of each capacitor.

According to a seventeenth aspect of the present invention, in the semiconductor integrated circuit of the first aspect, the voltage divider sets the voltage ratio at different values according to control signals.

According to an eighteenth aspect of the present invention, in the semiconductor integrated circuit of the seventeenth aspect, the voltage divider comprises a plurality of resistors connected in series between the output terminal of the output circuit and the output terminal of the reference voltage generator; at least one transistor having an end connected to any of the nodes between the plural resistors, and the other end connected to the output terminal of the output circuit; a control circuit being supplied with the control signal, and giving a control voltage based on the control signal to a control end of the transistor; and an output terminal for taking out the divided voltage, connected to any of the nodes between the plural resistors.

According to a nineteenth aspect of the present invention, in the semiconductor integrated circuit of Claim 17 wherein the voltage divider comprises a plurality of diode-junction type transistors connected in series between the output end of the output circuit and the output end of the reference voltage generator, each transistor having a gate and a drain connected to each other, and a source connected to a substrate; at least; one transistor for voltage control having an end connected to any of the nodes between the plural transistors, and the other end connected to the output end of the output circuit; a control circuit being supplied with the control signal, and giving a control voltage based on the control signal to a control end of the transistor for voltage control; and an output terminal for taking out a divided voltage, connected to any of the nodes between the plural transistors.

According to a twentieth aspect of the present invention, in the semiconductor integrated circuit of the seventeenth aspect, the voltage divider comprises a plurality of capacitors connected in series between the output terminal of the output circuit and the output terminal of the reference voltage generator; at least one transistor having an end connected to any of the nodes between the plural capacitors, and the other end connected to the output terminal of the output circuit; a control circuit being supplied with the control signal, and giving a control voltage based on the control signal to a control end of the transistor; an initialization circuit performing initialization by short-circuiting the both ends of each capacitor; and an output terminal for taking out the divided voltage, connected to any of the nodes between the plural capacitors.

According to a twenty-first aspect of the present invention, in the semiconductor integrated circuit of the seventeenth aspect, the voltage divider comprises two first capacitors connected in series between the output terminal of the output circuit and the output terminal of the reference voltage generator; at least one transistor having an end connected to a node between the first capacitors; at least one second capacitor, as many as the transistor, having an end connected to the transistor, and the other end connected to the output terminal of the reference voltage generator; a control circuit being supplied with the control signal, and giving a control voltage based on the control signal to a control end of the transistor; an initialization circuit for initializing the node between the first capacitors; and an output terminal for taking out the divided voltage, connected to the node between the first capacitors.

According to a twenty-second aspect of the present invention, in the semiconductor integrated circuit of the thirteenth aspect, the output circuit comprises a first N type MOS transistor having a gate, a source connected to the output terminal of the negative booster, and a drain connected to the output terminal of the output circuit; a second N type MOS transistor having a gate, a source connected to the output terminal of the negative booster, and a drain connected to the gate of the first N type MOS transistor; a P type MOS transistor having a source connected to the power supply voltage, a drain connected to the drain of the second N type MOS transistor, and a gate connected to the output terminal of the differential amplifier; and a bias circuit for giving a bias voltage to the gate of the second N type MOS transistor.

According to a twenty-third aspect of the present invention, in the semiconductor integrated circuit of the thirteenth aspect, the output circuit comprises a first N type MOS transistor having a gate, a source connected to the output terminal of the negative booster, and a drain connected to the output terminal of the output circuit; a second N type MOS transistor having a source connected to the output terminal of the negative booster, and a gate and a drain connected to the gate of the first N type MOS transistor; and a P type MOS transistor having a source connected to the power supply voltage, a drain connected to the drain of the second N type MOS transistor, and a gate connected to the output terminal of the differential amplifier.

According to a twenty-fourth aspect of the present invention, in the semiconductor integrated circuit of the thirteenth aspect, the output circuit comprises a first N type MOS transistor having a gate, a source connected to the output terminal of the negative booster, and a drain connected to the output terminal of the output circuit; a second N type MOS transistor having a source connected to the output terminal of the negative booster, a drain connected to the gate of the first N type MOS transistor, and a gate being grounded; and a P type MOS transistor having a source connected to the power supply voltage, a drain connected to the drain of the second N type MOS transistor, and a gate connected to the output terminal of the differential amplifier.

According to a twenty-fifth aspect of the present invention, there is provided a semiconductor integrated circuit comprising a booster for boosting a power supply voltage, and outputting the boosted voltage; a first output circuit being supplied with the boosted voltage, generating an output voltage from the boosted voltage, and outputting the output voltage through an output terminal; a reference voltage generator being supplied with the power supply voltage, generating a reference voltage from the power supply voltage, and outputting the reference voltage; a first voltage divider being supplied with the output voltage from the first output circuit, dividing the output voltage according to a predetermined voltage ratio, and outputting the divided voltage; a first differential amplifier being supplied with the reference voltage and the divided voltage from the first voltage divider, and controlling the first output circuit by supplying it with a voltage which is obtained by performing differential amplification on the reference voltage and the divided voltage according to the power supply voltage, thereby maintaining the output voltage from the first output circuit at a predetermined voltage; a negative booster for generating a negative voltage from the power supply voltage, and outputting the negative voltage; a second output circuit being supplied with the negative voltage, generating an output voltage from the negative voltage, and outputting the output voltage through an output terminal; a second voltage divider being supplied with the output voltage from the second output circuit and the reference voltage, dividing a potential difference between the output voltage and the reference voltage according to a predetermined voltage ratio, and outputting the divided voltage; and a second differential amplifier being supplied with the divided voltage from the second voltage divider and the ground voltage, and controlling the second output circuit by supplying it with a voltage which is obtained by performing differential amplification on the divided voltage and the reference voltage according to the power supply voltage, thereby maintaining the output voltage from the second output circuit at a predetermined voltage.

According to a twenty-sixth aspect of the present invention, in the semiconductor integrated circuit of the twenty-fifth aspect, the first voltage divider comprises a plurality of diode-junction type transistors connected in series between the output terminal of the first output circuit and the ground voltage, each transistor having a gate and a drain connected to each other, and a source connected to a substrate; at least one transistor for voltage control having an end connected to any of the nodes between the plural transistors, and the other end connected to the output terminal of the first output circuit; a control circuit being supplied with the control signal, and giving a control voltage based on the control signal to a control end of the transistor for voltage control; and an output terminal for taking out the divided voltage, connected to any of the nodes between the plural transistors.

According to a twenty-seventh aspect of the present invention, in the semiconductor integrated circuit of the twenty-fifth aspect, the second voltage divider comprises a plurality of diode-junction type transistors connected in series between the output terminal of the second output circuit and the output terminal of the reference voltage generator, each transistor having a gate and a drain connected to each other, and a source connected to a substrate; at least one transistor for voltage control having an end connected to any of the nodes between the plural transistors, and the other end connected to the output terminal of the second output circuit; a control circuit being supplied with the control signal, and giving a control voltage based on the control signal to a control end of the transistor for voltage control; and an output terminal for taking out the divided voltage, connected to any of the nodes between the plural transistors According to a twenty-eighth aspect of the present invention, the semiconductor integrated circuit of the twenty-fifth aspect further comprises a voltage follower circuit being supplied with the output from the reference voltage generator; and the second voltage divider is supplied with the output voltage from the voltage follower circuit, as the reference voltage, instead of the output from the reference voltage generator.

DETAILED DESCRIPTION OF THE PREFERRED EMBODIMENTS

[Embodiment 1]

Hereinafter, a semiconductor IC according to a first embodiment of the present invention will be described with reference to the drawings.

Figure 1:
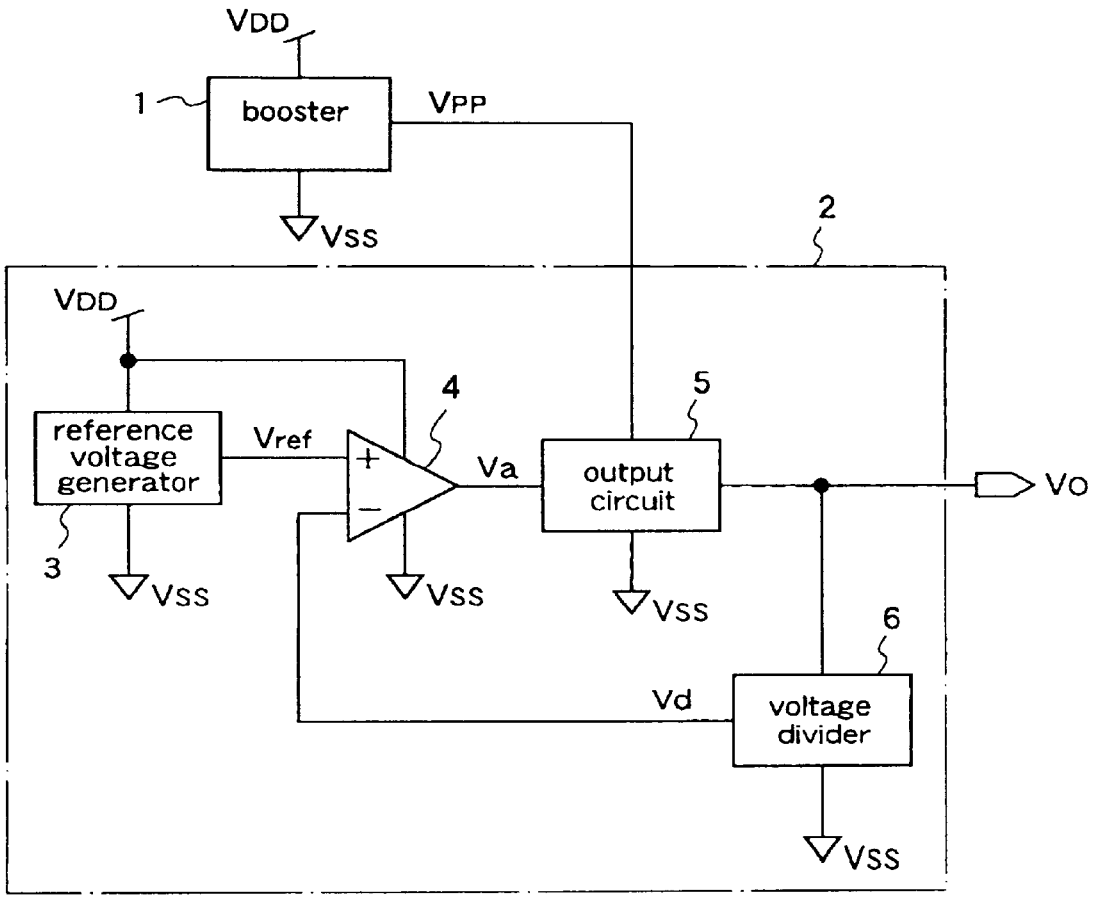
FIG. 1 is a block diagram illustrating a semiconductor IC according to a first embodiment of the present invention.

FIG. 1 is a block diagram illustrating the structure of a semiconductor IC according to the first embodiment.

In FIG. 1, the semiconductor IC comprises a booster 1, and a regulator 2. The booster 1 increases a power supply voltage $V_{DD}$ applied to the semiconductor IC, to a predetermined voltage $V_{PP}$. The regulator 2 is supplied with the boosted voltage $V_{PP}$, and outputs an output voltage Vo. As an example of the booster 1, a charge pump circuit is employed. The regulator 2 comprises a reference voltage generator 3, a differential amplifier 4, an output circuit 5, and a voltage divider 6.

The reference voltage generator 3 is supplied with the power supply voltage $V_{DD}$ of the semiconductor IC, generates a predetermined reference voltage Vref, and outputs it. The differential amplifier 4 is supplied with the reference voltage Vref generated by the reference voltage generator 3 and a divided voltage Vd (described later) from the voltage divider 6, and performs differential amplification on the basis of the power supply voltage $V_{DD}$. The reference voltage generator 3 is operated with the power supply voltage $V_{DD}$ applied to the semiconductor IC, which voltage $V_{DD}$ is input to a power input terminal (not shown) of the generator 4. The output circuit 5 controls the boosted voltage $V_{PP}$ using, as a control voltage, the output voltage Va from the differential amplifier 4 to generate an output voltage Vo of the regulator 2, and outputs this voltage Vo to the outside of the regulator 2. The voltage divider 6 divides the output voltage Vo from the output circuit 5 with a predetermined voltage radio, and outputs a divided voltage Vd.

Next, the operation of the semiconductor IC will be described.

The booster 1 boosts the power supply voltage $V_{DD}$ to generate a voltage $V_{PP}$ higher than the power supply voltage $V_{DD}$, and outputs this voltage $V_{PP}$ to the regulator 2. The regulator 2 outputs a predetermined constant voltage Vo which is obtained by decreasing the boosted voltage $V_{PP}$, through an output terminal to the outside.

In the regulator 2, the reference voltage generator 3 generates a predetermined reference voltage Vref from the power supply voltage $V_{DD}$. Accordingly, the reference voltage Vref has a value in a range from the power supply voltage $V_{DD}$ to the ground voltage $V_{SS}$. The voltage divider 6 is supplied with the output voltage from the regulator 2, i.e., the output voltage Vo from the output circuit 5, and outputs a divided voltage Vd which is obtained by dividing the output voltage Vo with a predetermined voltage ratio r ($r \geqq 1$) so that the relationship VO/Vd=r is satisfied.

Figure 2:
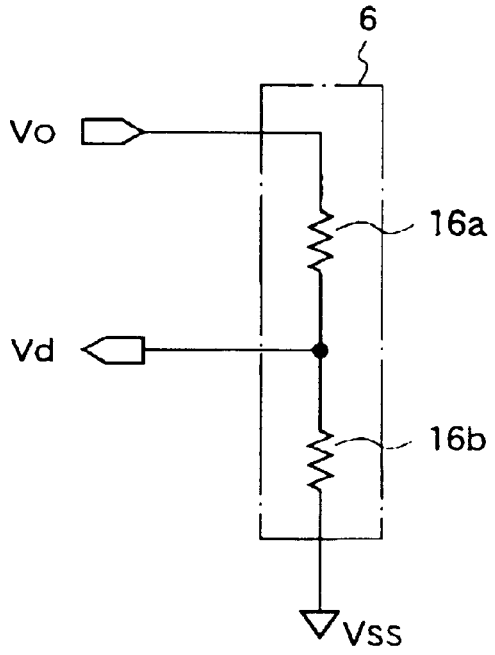
FIG. 2 is a circuit diagram illustrating an example of a voltage divider according to the first embodiment.

FIG. 2 is a circuit diagram illustrating an example of the voltage divider 6.

FIG. 2 shows a resistance type voltage divider comprising resistors 16*a* and 16*b* connected in series between the output terminal of the output circuit 5 and the ground voltage $V_{SS}$, and an output terminal connected to a node between the resistors 16*a* and 16*b*, from which the divided voltage Vd is taken out. The number of resistors serially connected may be more than two.

The output voltage Vd from the voltage divider 6 and the reference voltage Vref from the reference voltage generator 3 are applied to the differential amplifier 4. On the basis of the power supply voltage $V_{DD}$, the differential amplifier 4 compares the output voltage Vd with the reference voltage Vref, amplifies a difference between these voltages Vd and Vref, and outputs a voltage Va so obtained to the output circuit 5. The output circuit 5 is controlled by this output voltage Va, whereby the output voltage Vd from the voltage divider 6 becomes Vd=Vref. Then, the output circuit 5 outputs a voltage Vo=r·Vref which is obtained by decreasing the boosted voltage $V_{PP}$. In this way, the output voltage Vo from the regulator 2 is maintained at a constant voltage Vo=r·Vref. The reference voltage generator 3 is previously set so as to generate a reference voltage Vref by which a desired output voltage Vo is obtained.

Figure 3:
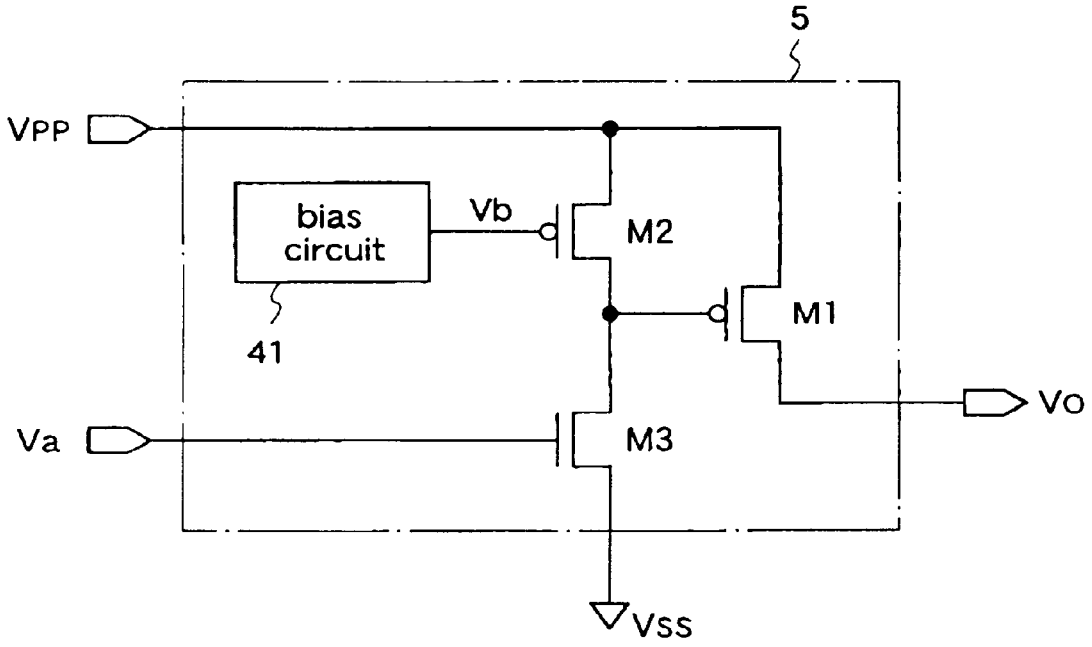
FIG. 3 is a circuit diagram illustrating an example of an output circuit according to the first embodiment.

FIG. 3 is a circuit diagram illustrating an example of the output circuit 5.

In FIG. 3, the output circuit 5 comprises a P type MOS transistor M1, a p type MOS transistor M2, an N type MOS transistor M3, and a bias circuit 41. The P type MOS transistor M2 has a source connected to the output terminal of the booster 1, to which the boosted voltage $V_{PP}$ is applied. Further, the transistor M2 has a gate to which a bias voltage Vb from the bias circuit 41 is applied. The N type MOS transistor M3 has a source being grounded, a drain connected to a drain of the P type MOS transistor M2, and a gate to which the output voltage Va from the differential amplifier 4 is applied. The P type MOS transistor M1 has a source to which the boosted voltage $V_{PP}$ is applied, a gate connected to the drain of the P type MOS transistor M2, and a drain serving as an output terminal for the output voltage Vo. In the output circuit 5 so constructed, the gate voltage of the P type MOS transistor M1 is varied according to variation of the output voltage Va from the differential amplifier 5, and the boosted voltage $V_{PP}$ applied to the source of the P type MOS transistor M1 is controlled according to the gate voltage, and the voltage so controlled is output as the output voltage Vo. As the result, the output voltage Vo to be output from the output terminal can be controlled by the output voltage Va from the differential amplifier 4, whereby the boosted voltage $V_{PP}$ which is not always stable is reduced by the regulator 2 to output a stable and constant voltage Vo from the output terminal to the outside.

As described above, since the semiconductor IC of this first embodiment is provided with the reference voltage generator 3 and the differential amplifier 4 which are operated with the power supply voltage $V_{DD}$, there is no necessity of applying the boosted voltage $V_{PP}$ to the reference voltage generator 3 and the difference amplifier 4, and the output current from the booster 1 is reduced, whereby undesired reduction in the boosted voltage $V_{PP}$ due to an increase in the output current is minimized. Therefore, the capacitance used for the booster 1 is reduced, with the result that the area of the semiconductor IC is reduced.

Although in this first embodiment the output circuit 5 shown in FIG. 3 is described, this is only one example, and other output circuits may be employed.

Figure 4:
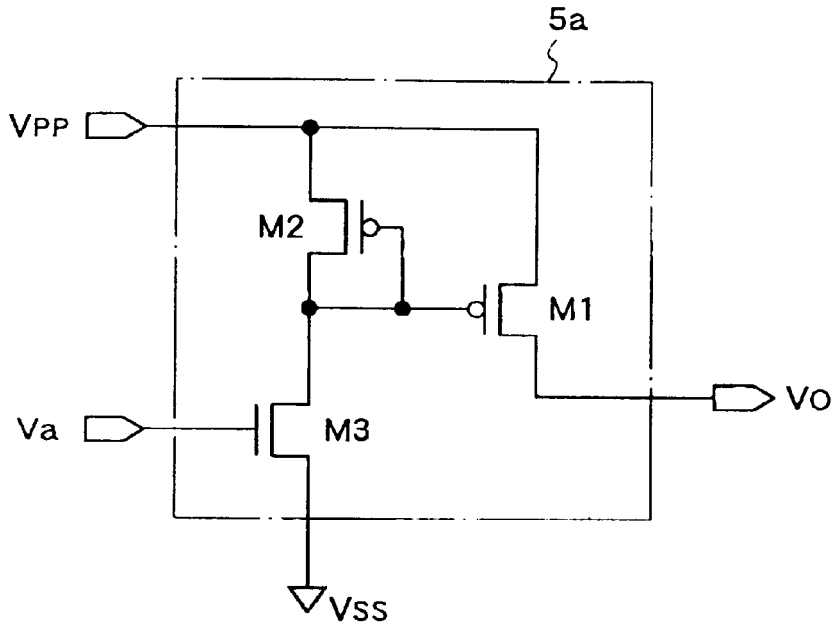
FIG. 4 is a circuit diagram illustrating another example of an output circuit according to the first embodiment.
Figure 5:
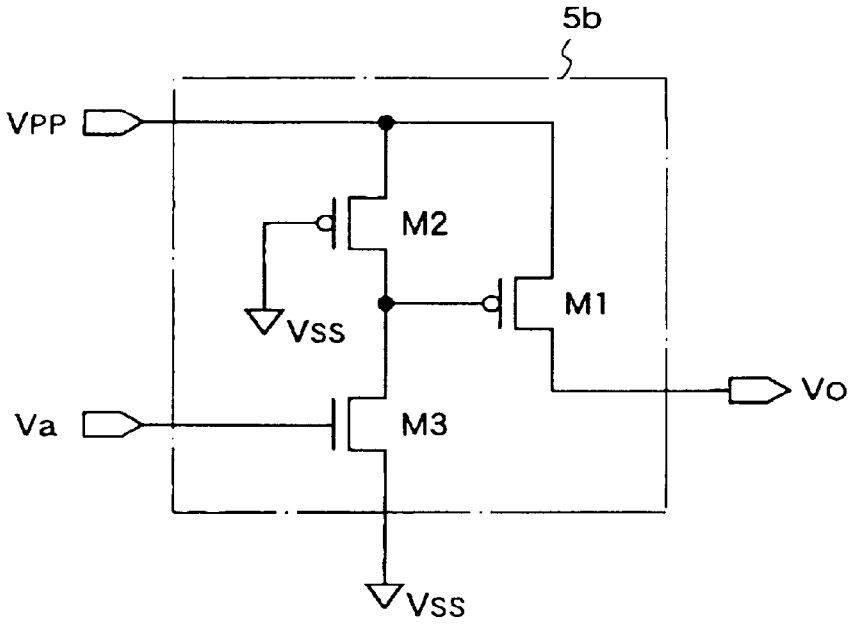
FIG. 5 is a circuit diagram illustrating still another example of an output circuit according to the first embodiment.

FIGS. 4 and 5 are circuit diagrams illustrating output circuits 5*a* and 5*b* which are also applicable to the semiconductor IC of the first embodiment.

For example, the output circuit 5*a* shown in FIG. 4 is obtained by removing the bias circuit 41 from the output circuit 5 shown in FIG. 3, and connecting the gate of the P type MOS transistor to its drain. This output circuit 5*a* operates in like manner as described for the output circuit 5 shown in FIG. 3.

Further, the output circuit 5*b* shown in FIG. 5 is obtained by removing the bias circuit 41 from the output circuit 5 shown in FIG. 3, and grounding the gate of the P type MOS transistor M2. This output circuit 5*b* operates in like manner as described for the output circuit 5 shown in FIG. 3.

While in this first embodiment the output circuits 5, 5*a*, and 5*b* shown in FIGS. 3 to 5 are described, the output circuit of the present invention is not restricted thereto, and any output circuit may be employed so long as it operates in like manner as described for these output circuits 5, 5*a*, and 5*b*.

Moreover, the voltage divider 6 shown in FIG. 2 is only one example, and other voltage dividers may be employed.

Figure 6:
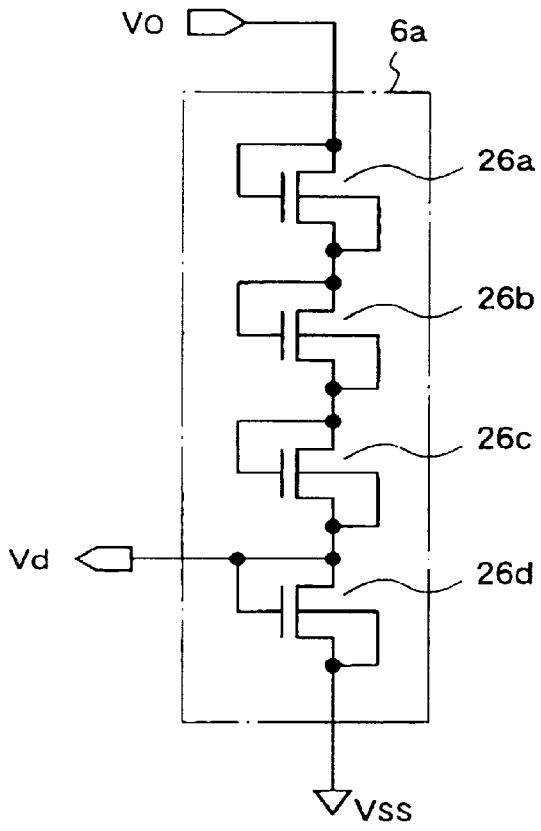
FIG. 6 is a circuit diagram illustrating another example of a voltage divider according to the first embodiment.
Figure 7:
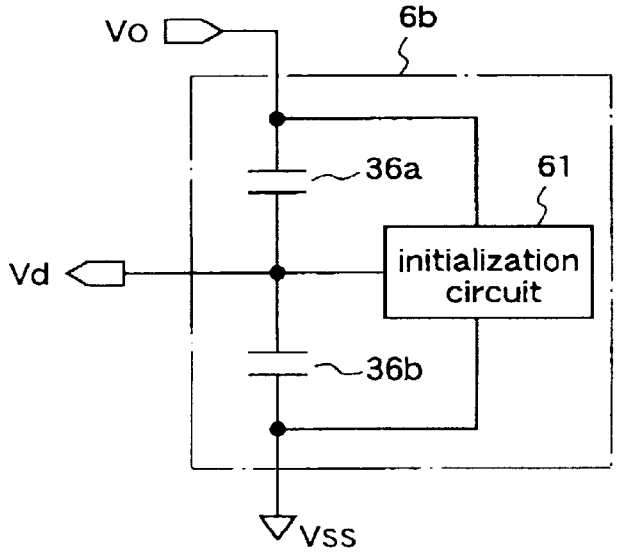
FIG. 7 is a circuit diagram illustrating still another example of a voltage divider according to the first embodiment.

FIGS. 6 and 7 are circuit diagrams illustrating voltage dividers 6*a* and 6*b* which are also applicable to the semiconductor IC of the first embodiment.

For example, in the voltage divider 6*a* shown in FIG. 6, a plurality of diode-junction N type MOS transistors 26*a* to 26*d*, each having a gate and a drain connected to each other and a source connected to a substrate, are connected in series between the output terminal of the output circuit 5 and the ground voltage $V_{SS}$. The voltage divider 6*a* outputs a divided voltage Vd from an output terminal which is connected to any of the nodes between the N type MOS transistors 26*a* to 26*d*. In place of the N type MOS transistors 26*a* to 26*d*, diode-junction P type MOS transistors may be employed.

In the voltage divider 6*b* shown in FIG. 7 comprises capacitors 36*a* and 36*b* connected in series between the output terminal of the output circuit 5 and the ground voltage $V_{SS}$, an initialization circuit 61 performing initialization by short-circuiting the both ends of each capacitor, and an output terminal connected to a node between the capacitors 36*a* and 36*b*, from which the divided voltage Vd is taken out.

While in this first embodiment the voltage dividers 6, 6*a*, and 6*b* shown in FIGS. 2, 6, and 7 are described, the voltage divider of the present invention is not restricted thereto. Any voltage divider may be used so long as it can operate in like manner as described for these voltage dividers.

[Embodiment 2]

Hereinafter, a semiconductor IC according to a second embodiment of the present invention will be described with reference to the drawings.

Figure 8:
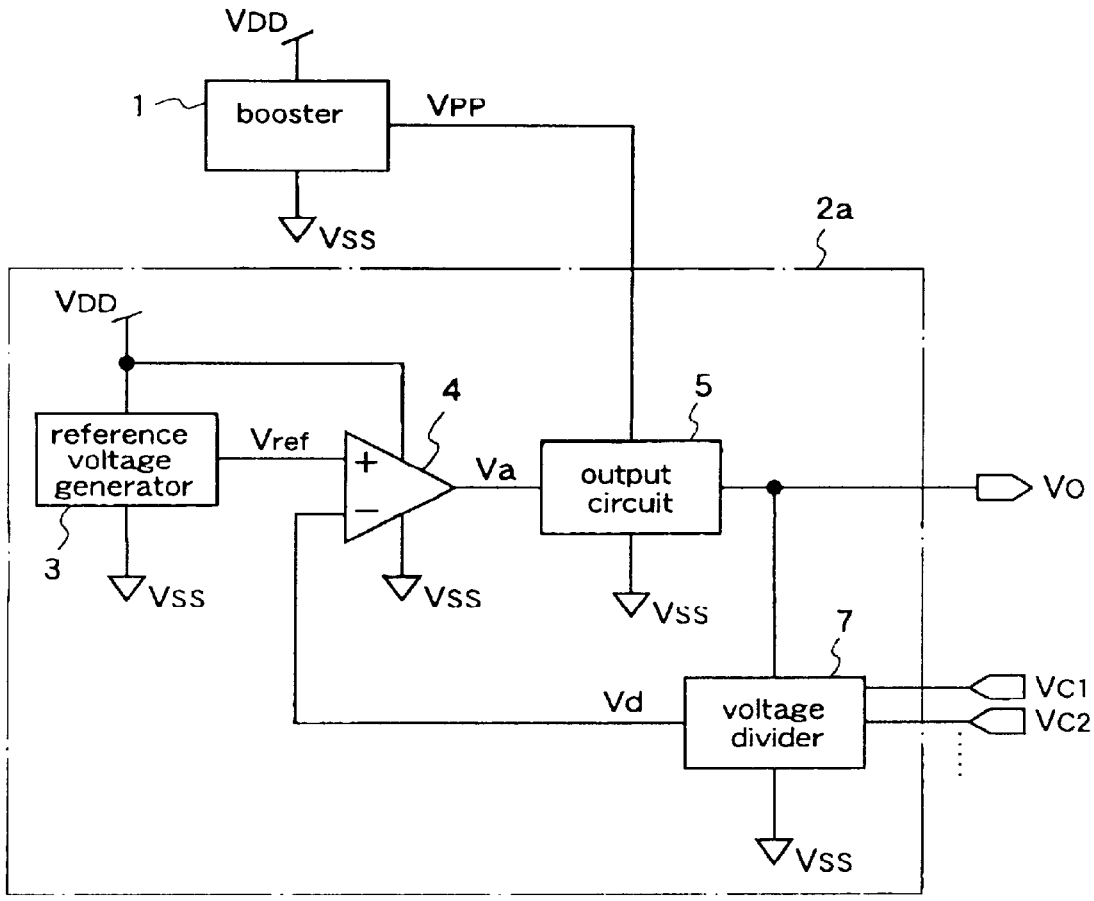
FIG. 8 is a block diagram illustrating a semiconductor IC according to a second embodiment of the present invention.

FIG. 8 is a block diagram illustrating a semiconductor IC according to the second embodiment.

In FIG. 8, the same reference numerals as those shown in FIG. 1 designate the same or corresponding parts. The semiconductor IC of this second embodiment is different from the semiconductor IC of the first embodiment only in that a regulator 2*a* includes a voltage divider 7 which can change the voltage radio according to control signals $V_{C1}$ and $V_{C2}$.

Figure 9:
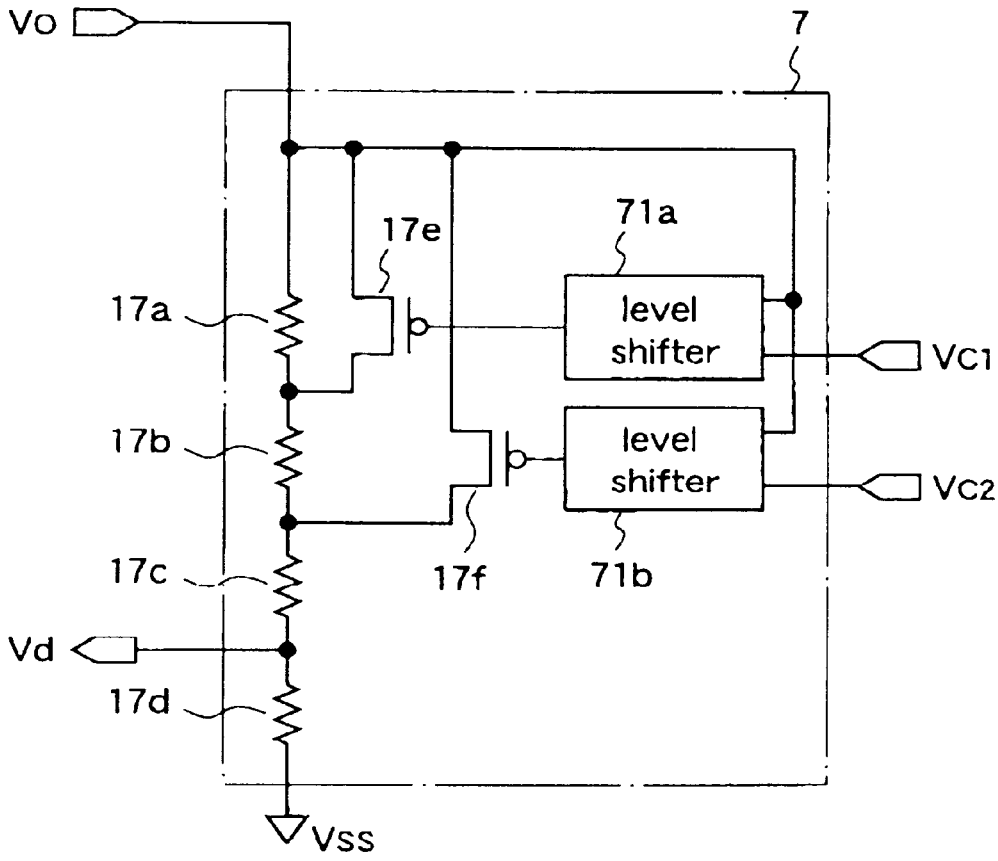
FIG. 9 is a circuit diagram illustrating an example of a voltage divider according to the second embodiment.

FIG. 9 is a circuit diagram illustrating an example of the voltage divider 7.

In FIG. 9, the voltage divider 7 comprises a plurality of resistors 17*a* to 17*d* which are connected in series between the output terminal of the output circuit 5 and the ground voltage $V_{SS}$, level shifters 71*a* and 71*b*, P type MOS transistors 17*e* and 17*f* for voltage control, and an output terminal for outputting a divided voltage Vd. Each of the level shifters 71*a* and 71*b* is supplied with an output voltage Vo from the regulator 2*a*, and control signals $V_{C1}$ and $V_{C2}$ supplied from the outside. The P type MOS transistor 17*e* for voltage control has a source connected to the output terminal of the output circuit 5, a drain connected to a node between the resistors 17*a* and 17*b*, and a gate serving as a control terminal to which the output from the level shifter 71*a* is applied. The P type MOS transistor 17*f* for voltage control has a source connected to the output terminal of the output circuit 5, a drain connected to a node between the resistors 17*b* and 17*c*, and a gate serving as a control terminal to which the output of the level shifter 71*b* is applied. An output terminal for outputting the divided voltage Vd is connected to a node between the resistors 17*c* and 17*d*. The level shifters 71*a* and 71*b* perform level shift on the control signals $V_{C1}$ and $V_{C2}$, each having a H level of $V_{DD}$ and a L level of $V_{SS}$, such that the H level and the L level become Vo and $V_{SS}$, respectively. In this way, the level shifters 71*a* and 71*b* are used as control circuits for outputting control voltages based on the control signals $V_{C1}$ and $V_{C2}$, respectively. In the voltage divider 7, the P type MOS transistors 17*e* and 17*f* are turned on or off by inputting the control signals $V_{C1}$ and $V_{C2}$ to the level shifters 71*a* and 71*b*, respectively, and thus the resistance ratio is changed, whereby the voltage ratio r of the divided voltage Vd can be changed.

Next, the operation of the semiconductor IC according to this second embodiment will be described. The constituents of the IC other than the voltage divider 7 operate in the same manner as described for the first embodiment and, therefore, repeated description is not necessary.

The voltage divider 7 outputs a divided voltage Vd which is obtained by dividing the output voltage Vo from the regulator 2*a*, according to a voltage ratio r ($r \geqq 1$) that depends on the control signals $V_{C1}$ and $V_{C2}$, so as to satisfy the relationship Vo/Vd=r. Then, the voltage divider 7 changes the control signals $V_{C1}$ and $V_{C2}$ to change the voltage ratio r, thereby controlling the divided voltage Vd.

As described above, since the semiconductor IC according to this second embodiment is provided with the voltage divider 7 which can change the voltage ratio r according to the control signals $V_{C1}$ and $V_{C2}$, the output voltage Vo from the regulator 2*a* can be changed by changing the control signals $V_{C1}$ and $V_{C2}$, without changing the reference voltage Vref as in the conventional semiconductor IC. Thereby, different output, voltages Vo to be used in different operation modes of a nonvolatile semiconductor memory device, such as erasing, writing, etc., can be generated using one reference voltage Vref. Therefore, the reference voltage generator 3 does not need to generate plural reference voltages Vref, and thus the reference voltage generator 3 is simplified and reduced in scale. As the result, the area of the semiconductor IC is reduced.

While in this second embodiment the voltage divider 7 shown in FIG. 9 is described, this is only one example, and other voltage dividers may be employed.

For example, although the voltage divider 7 includes four resistors connected in series, the number of resistors may be other than four. Also in this case, the drain of each of the transistors 17*e* and 17*f* for voltage control is connected to any of the nodes between these resistors, and an output terminal for taking the divided voltage Vd is connected to any of the nodes between these resistors.

Further, although the voltage divider 7 includes two transistors for voltage control, the number of transistors for voltage control may be one or more than two.

Figure 10:
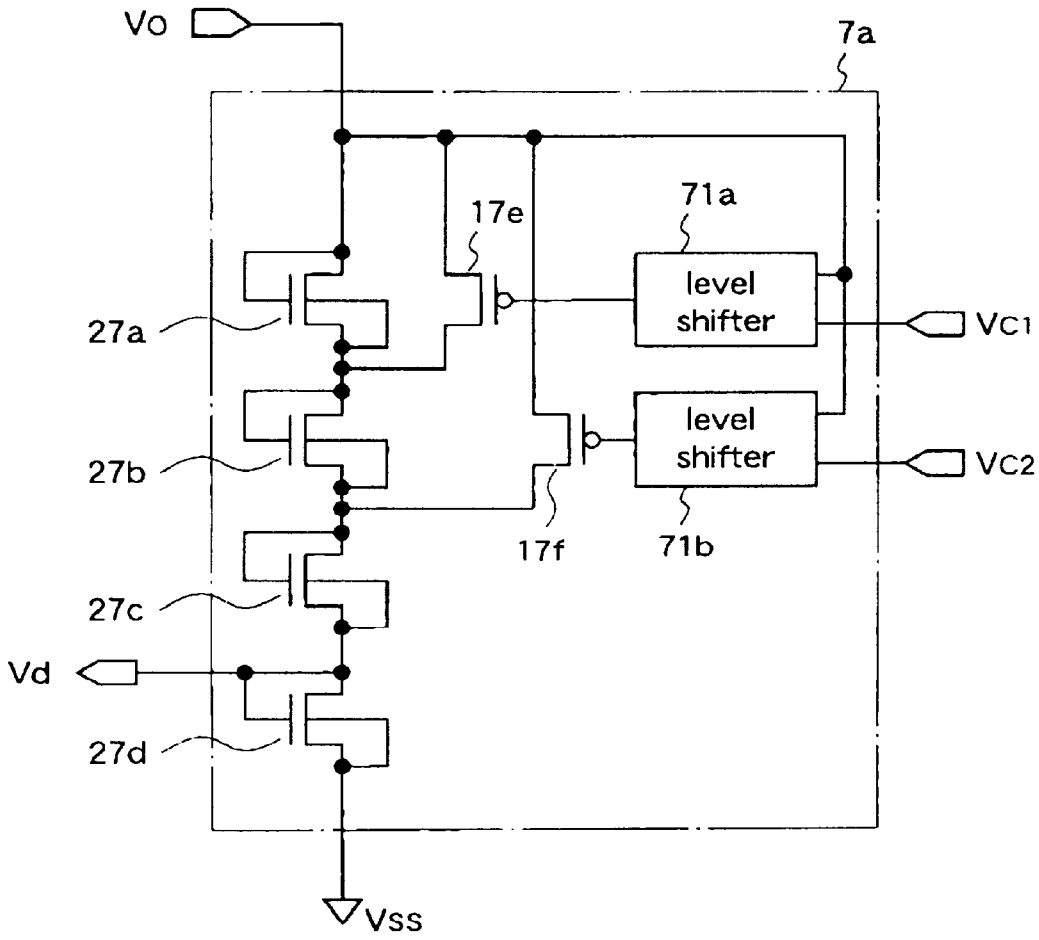
FIG. 10 is a circuit diagram illustrating another example of a voltage divider according to the second embodiment.
Figure 11:
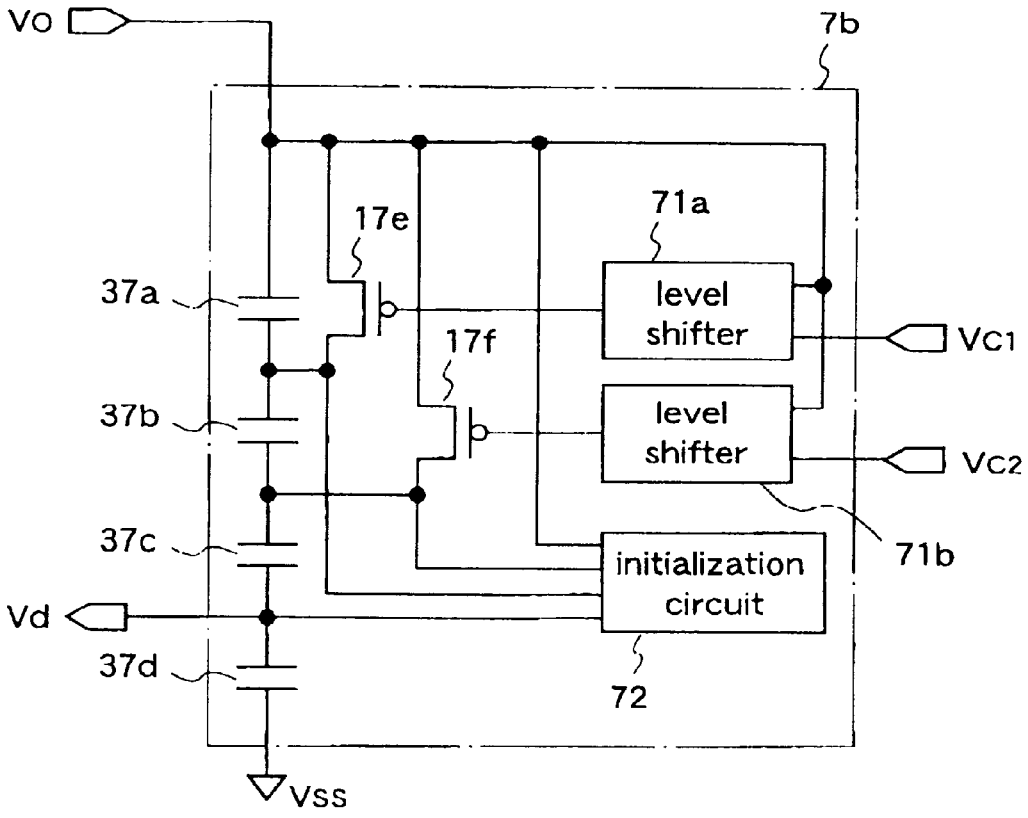
FIG. 11 is a circuit diagram illustrating still another example of a voltage divider according to the second embodiment.
Figure 12:
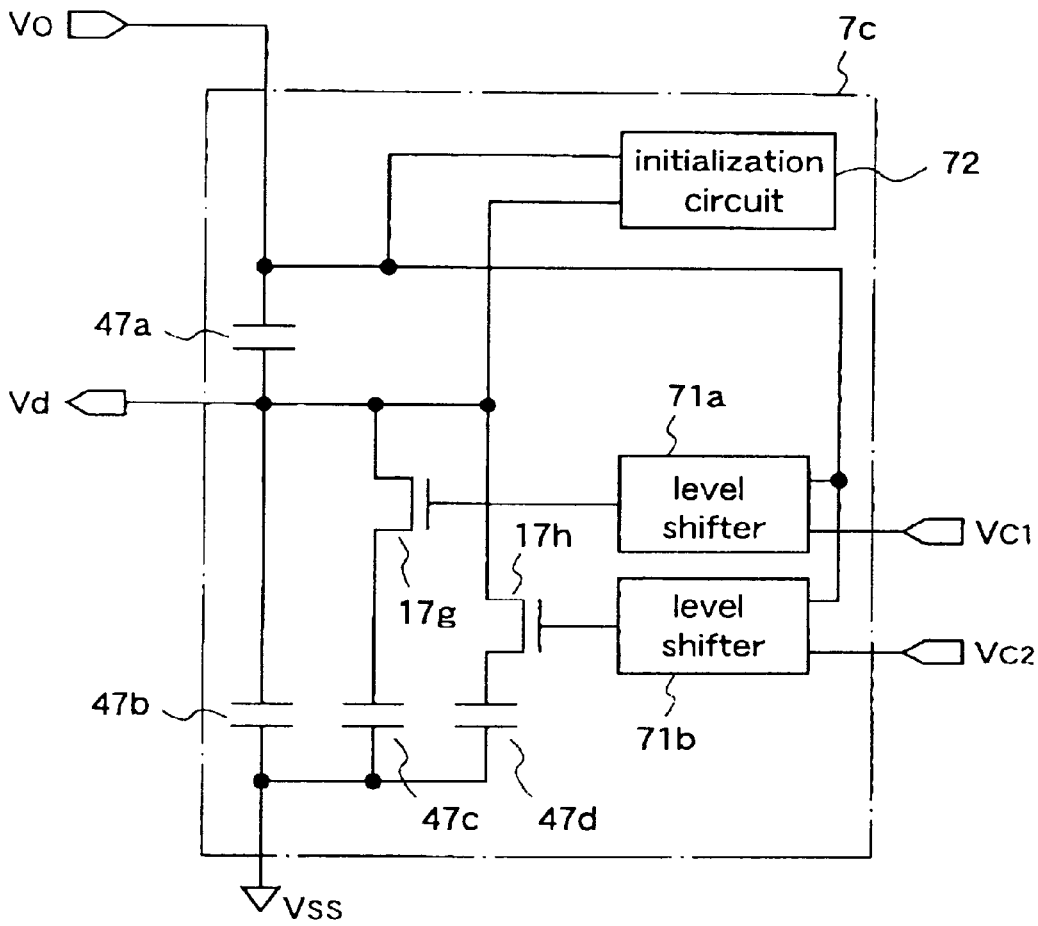
FIG. 12 is a circuit diagram illustrating a further example of a voltage divider according to the second embodiment.

FIGS. 10, 11, and 12 are circuit diagrams illustrating voltage dividers 7*a*, 7*b*, and 7*c* which are also applicable to the semiconductor IC of this second embodiment.

The voltage divider 7*a* shown in FIG. 10 comprises a plurality of N type MOS transistors 27*a* to 27*d* connected in series between the output terminal of the output circuit 5 and the ground voltage $V_{SS}$, level shifters 71*a* and 71*b*, P type MOS transistors 17*e* and 17*f* for voltage control, and an output terminal for outputting a divided voltage Vd.

The N type MOS transistors 27*a* to 27*d* are diode-junction MOS transistors, each having a gate and a drain connected to each other, and a source connected to a substrate. The level shifters 71*a* and 71*b* and the P type MOS transistors 17*e* and 17*f* are identical to those of the voltage divider 7 shown in FIG. 9 and, therefore, do not require repeated description. The output terminal for the divided voltage Vd is connected to the gate and the source of the transistor 27*d*.

In the voltage divider 7*a*, as in the voltage divider 7, the voltage ratio r of the divided voltage Vd can be changed by turning on or off the P type MOS transistors 17*e* and 17*f* for voltage control according to the control signals $V_{C1}$ and $V_{C2}$.

By the way, in the voltage divider 7, a high resistance is required for reducing the current which flows from the output terminal of the regulator 2*a* through the resistors. This is disadvantageous in respect of the area. On the other hand, when the N type MOS transistors 27*a* to 27*d* of the same characteristics are used in the voltage divider 7*a*, a voltage equal to the divided voltage Vd is applied to the gate-to-source portion of each of the N type MOS transistors 27*a* to 27*d*. Further, when the regulator 2*a* is operating, the divided voltage Vd becomes equal to the reference voltage Vref. Therefore, by setting the reference voltage Vref at a level a little higher than the threshold voltage of the N type MOS transistors 27*a* to 27*d*, the gate-to-source voltage of each N type MOS transistor becomes a little higher than the threshold voltage when the regulator 2*a* is operating, whereby the voltage divider 7*a* can be operated while minimizing the current which flows through the voltage divider 7*a*. Since the current from the output terminal of the regulator 2*a* can be minimized, the scale of the booster 1 can be minimized, resulting in further reduction in the circuit scale of the semiconductor IC as compared with the case of using the voltage divider 7 having the resistors. Diode-junction P type MOS transistors may be used in place of the N type MOS transistors 27*a* to 27*d*.

Further, the voltage divider 7*b* shown in FIG. 11 comprises a plurality of capacitors 37*a* to 37*d* connected in series between the output terminal of the output circuit 5 and the ground voltage $V_{SS}$, an initialization circuit 72, level shifters 71*a* and 71*b*, P type MOS transistors 17*e* and 17*f* for voltage control, and an output terminal for outputting a divided voltage Vd.

The initialization circuit 72 performs initialization by short-circuiting the both ends of each of the capacitors 37*a* to 37*d*. The level shifters 71*a* and 71*b* and the P type MOS transistors 17*e* and 17*f* are identical to those of the voltage divider 7 shown in FIG. 9 and, therefore, do not require repeated description. The output terminal for outputting the divided voltage Vd is connected to a node between the capacitor 37*c* and the capacitor 37*d*.

In the voltage divider 7*b*, as in the voltage divider 7, the level shifters 71*a* and 71*b* decide ON or OFF of the P type MOS transistors 17*e* and 17*f* according to the control signals $V_{C1}$ and $V_{C2}$ and, thereafter, the initialization circuit 72 initializes the capacitors 37*a* to 37*d*, whereby the voltage ratio r of the divided voltage Vd is changed according to the control signals $V_{C1}$ and $V_{C2}$. In comparison with the voltage dividers 7 and 7*a*, the voltage divider 7*b* needs to initialize the capacitors, but the current that flows in the voltage divider 7*b* is significantly reduced because the output from the regulator 2*a* has no dc component.

Further, the voltage divider 7*c* shown in FIG. 12 comprises capacitors 47*a* and 47*b* which are connected in series between the output terminal of the output circuit 5 and the ground voltage $V_{SS}$, capacitors 47*c* and 47*d* each having a grounded end, level shifters 71*a* and 71*b*, N type MOS transistors 17*g* and 17*h* for voltage control, an initialization circuit 72, and an output terminal for outputting a divided voltage Vd.

The N type MOS transistor 17*g* has a gate connected to the output of the level shifter 71*a*, a drain connected to a node between the capacitors 47*a* and 47*b*, and a source connected to an ungrounded end of the capacitor 47*c*. The N type MOS transistor 17*h* has a gate connected to the output of the level shifter 71*b*, a drain connected to a node between the capacitors 47*a* and 47*b*, and a source connected to an ungrounded end of the capacitor 47*d*. The initialization circuit 72 performs initialization by short-circuiting the both ends of each of the capacitors 47*a* to 47*d*. The level shifters 71*a* and 71*b* are identical to those of the voltage divider 7 shown in FIG. 9 and, therefore, do not require repeated description. The output terminal for outputting the divided voltage Vd is connected to a node between the capacitors 47*a* and 47*b*.

In the voltage divider 7*c*, as in the voltage divider 7, the level shifters 71*a* and 71*b* decide ON or OFF of the N type MOS transistors 17*g* and 17*h* for voltage control, according to the control signals $V_{C1}$ and $V_{C2}$ and, thereafter, the capacitors 47*a* to 47*d* are initialized by the initialization circuit 72, whereby the voltage ratio r of the divided voltage Vd can be changed according to the control signals $V_{C1}$ and $V_{C2}$. Also in this voltage divider 7*c*, as in the voltage divider 7*b*, the current from the output terminal of the regulator 2*a* can be significantly reduced.

While in this second embodiment the voltage dividers 7, 7*a*, 7*b*, and 7*c* shown in FIGS. 9 to 12 are described, the voltage divider of the present invention is not restricted thereto. Any voltage divider may be used so long as it can operate in like manner as described for these voltage dividers.

[Embodiment 3]

Hereinafter, a semiconductor IC according to a third embodiment of the present invention will be described with reference to the drawings.

Figure 13:
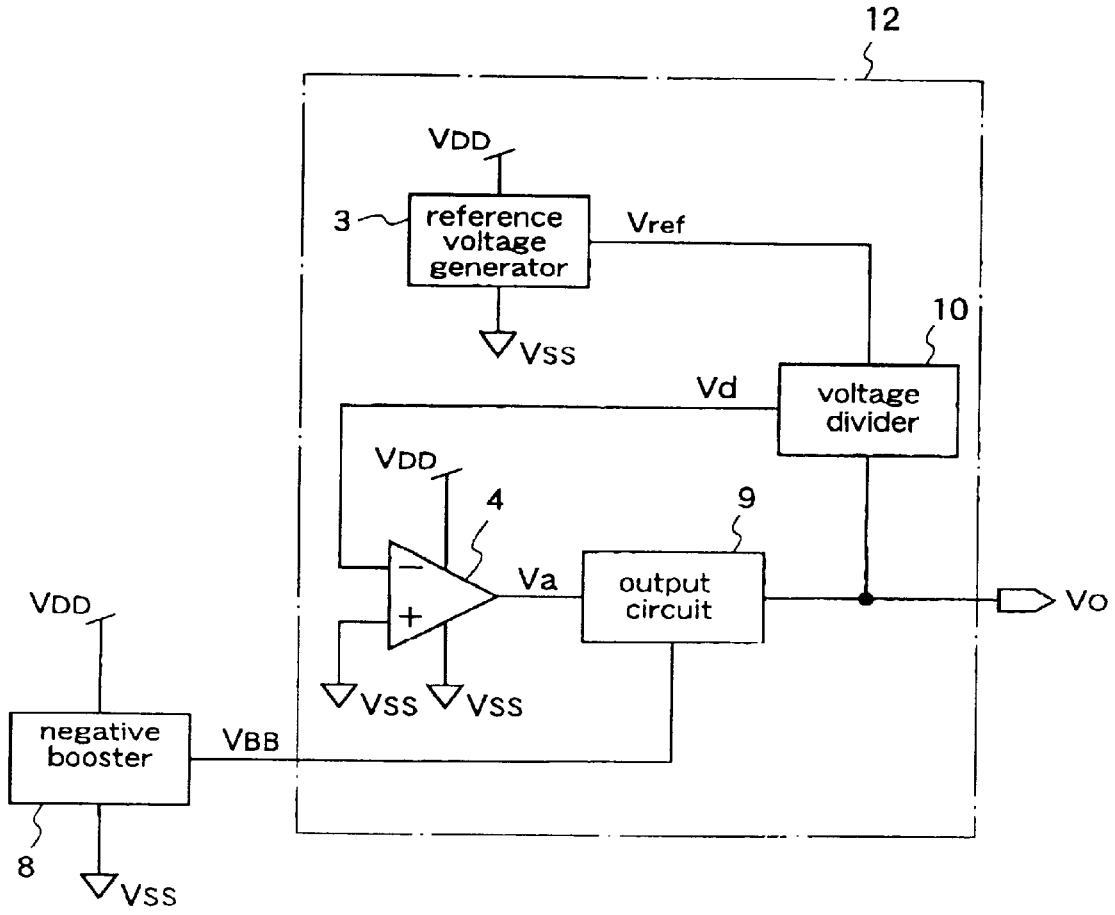
FIG. 13 is a block diagram illustrating a semiconductor IC according to a third embodiment of the present invention.

FIG. 13 is a block diagram illustrating a semiconductor IC according to the third embodiment.

In FIG. 13, the same reference numerals as those shown in FIG. 1 designate the same or corresponding parts. The semiconductor IC shown in FIG. 13 comprises a negative booster 8 and a regulator 12. The negative booster 8 generates a predetermined negative voltage $V_{BB}$ from a power supply voltage $V_{DD}$ applied to this semiconductor IC. The regulator 12 is supplied with the negative voltage $V_{BB}$ generated by the negative booster 8, and generates an output voltage Vo. For example, a charge pump circuit performing negative boosting is employed as the negative booster 8. The regulator 12 comprises a reference voltage generator 3, a differential amplifier 4, an output circuit 9, and a voltage divider 10.

The differential amplifier 4 is supplied with the divided voltage Vd from the voltage divider 10 and the ground voltage $V_{SS}$, and performs differential amplification according to the power supply voltage $V_{DD}$. The reference voltage generator 3 is operated with the power supply voltage $V_{DD}$ applied to the semiconductor IC, which is input to a power input terminal of the generator 4. The output circuit 9 generates an output voltage Vo by regulating the negative voltage $V_{BB}$ from the negative booster 8, using the output voltage Va from the differential amplifier 4 as a control voltage, and outputs this voltage Vo to the outside of the regulator 12. The voltage divider 10 is supplied with the reference voltage Vref and the output voltage Vo from the regulator 12, divides a potential difference between these voltages with a predetermined voltage ratio, and outputs a divided voltage Vd. Although the reference voltage generator 3 is identical to that of the first embodiment, when the output impedance of the reference voltage generator 3 is high, the output impedance may be reduced through a voltage follower.

Next, the operation of the semiconductor IC will be described.

The negative booster 8 generates a negative voltage $V_{BB}$ from the positive power supply voltage $V_{DD}$, and outputs this negative voltage $V_{BB}$ to the regulator 12. The regulator 12 is supplied with the negative voltage $V_{BB}$, and outputs a predetermined constant negative voltage Vo from its output terminal to the outside.

In the regulator 12, the reference voltage generator 3 generates a predetermined reference voltage Vref from the power supply voltage $V_{DD}$. Accordingly, the reference voltage Vref has a value in a range from the power supply voltage $V_{DD}$ to the ground voltage $V_{SS}$. The voltage divider 10 outputs a divided voltage Vd which is obtained by dividing a potential difference between the output voltage from the regulator 12 (i.e., the output voltage Vo from the output circuit 9) and the reference voltage Vref, according to a predetermined voltage ratio r, so as to satisfy the relationship (Vd−Vo)/(Vref−Vd)=r.

Figure 14:
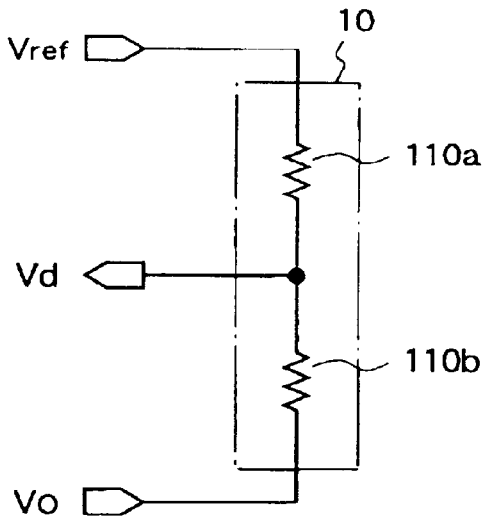
FIG. 14 is a circuit diagram illustrating an example of a voltage divider according to the third embodiment.

FIG. 14 is a circuit diagram illustrating an example of the voltage divider 10.

This voltage divider 10 comprises resistors 110*a* and 110*b* which are connected in series between the output terminal of the output circuit 9 and the output terminal of the reference voltage generator 3, and an output terminal connected to a node between these resistors 110*a* and 110*b*, from which the divided voltage vd is taken out. The number of the resistors connected in series may be more than two.

The divided voltage Vd from the voltage divider 10 and the ground voltage $V_{SS}$ are input to the differential amplifier 4. On the basis of the power supply voltage $V_{DD}$, the differential amplifier 4 compares the divided voltage Vd with the ground voltage $V_{SS}$, amplifies a difference of these voltages, and outputs a voltage Va so obtained to the output circuit 9. The output circuit 9 is controlled by this output voltage Va, and the divided voltage Vd from the voltage divider 10 becomes Vd=$V_{SS}$. Then, the output circuit 9 outputs a voltage Vo=−r·Vref which is obtained by regulating the negative voltage $V_{BB}$. In this way, the output voltage Vo from the regulator 12 is maintained at a constant negative voltage, Vo=−r·Vref The reference voltage generator 3 is previously set so as to generate a reference voltage Vref which provides a desired output voltage Vo.

Figure 15:
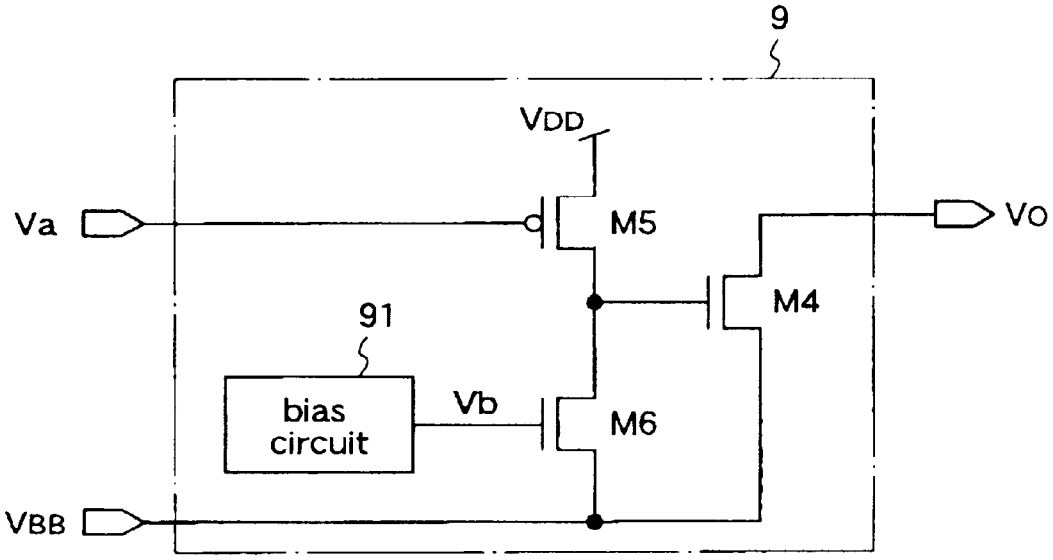
FIG. 15 is a circuit diagram illustrating an example of an output circuit according to the third embodiment.

FIG. 15 is a circuit diagram illustrating an example of the output circuit 9 according to this third embodiment.

In FIG. 15, the output circuit 9 comprises an N type MOS transistor M4, a p type MOS transistor M5, an N type MOS transistor M6, and a bias circuit 91. The P type MOS transistor M5 has a source connected to the power supply voltage $V_{DD}$, and a gate to which the output voltage Va from the differential amplifier 4 is applied. The N type MOS transistor M6 has a drain connected to a drain of the P type MOS transistor M5, a gate to which a bias voltage Vb from the bias circuit 91 is applied, and a source connected to the output terminal of the negative booster 8, to which the negative voltage $V_{BB}$ is applied. The N type MOS transistor M4 has a source connected to the output terminal of the negative booster 8, to which the negative voltage $V_{BB}$ is applied, a gate connected to the drain of the P type MOS transistor M5, and a drain serving as an output terminal for the output voltage Vo. In this output circuit 9, the N type MOS transistor M4 is controlled by the output from the circuit comprising the N type MOS transistor M6 to which the bias voltage Vb from the bias circuit 91 is applied at its gate, and the P type MOS transistor M5 to which the output voltage Va from the differential amplifier 4 is applied at its gate. Thereby, the voltage Vo at the output terminal can be controlled by the output voltage Va from the differential amplifier 4.

As described above, since the semiconductor IC of this third embodiment is provided with the reference voltage generator 3 and the differential amplifier 4 which are operated with the power supply voltage $V_{DD}$, there is no necessity of applying the negative voltage $V_{BB}$ to the reference voltage generator 3 and the differential amplifier 4, and the output current from the negative booster 8 is reduced, whereby undesired increase in the negative voltage $V_{BB}$ due to an increase in the output current from the negative booster 8 is minimized. As the result, the capacitance used in the negative booster 8 is reduced, whereby the area of the semiconductor IC is reduced.

Although in this third embodiment the output circuit 9 shown in FIG. 15 is described, this is only one example, and other output circuits may be employed.

Figure 16:
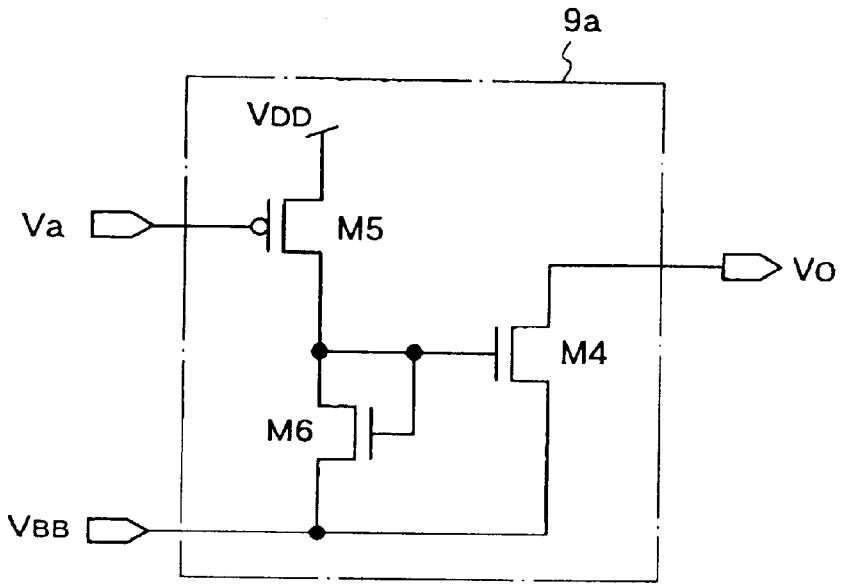
FIG. 16 is a circuit diagram illustrating another example of an output circuit according to the third embodiment.
Figure 17:
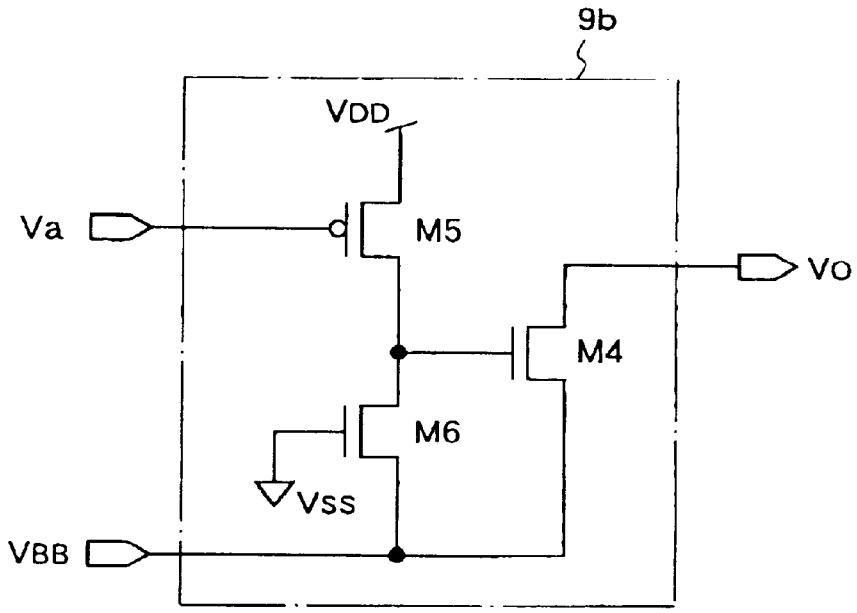
FIG. 17 is a circuit diagram illustrating still another example of an output circuit according to the third embodiment.

FIGS. 16 and 17 are circuit diagrams illustrating output circuits 9*a* and 9*b* which are applicable to the semiconductor IC of this third embodiment.

The output circuit 9*a* shown in FIG. 16 is obtained by removing the bias circuit 91 from the output circuit 9 shown in FIG. 15, and connecting the gate of the N type MOS transistor M6 to its drain. This output circuit 9*a* operates in like manner as the output circuit 9 shown in FIG. 15.

Further, output circuit 9*b* shown in FIG. 17 is obtained by removing the bias circuit 91 from the output circuit 9 shown in FIG. 15, and grounding the gate of the N type MOS transistor M6. This output circuit 9*b* also operates in like manner as the output circuit 9.

While in this third embodiment the output circuits 9, 9*a*, and 9*b* shown in FIGS. 15 to 17 are described, the output circuit of the present invention is not restricted thereto. Any output circuit may be employed so long as it operates in like manner as described for these output circuits.

Further, although in this third embodiment the voltage divider 10 shown in FIG. 14 is described, this is only one example, and other voltage dividers may be employed.

Figure 18:
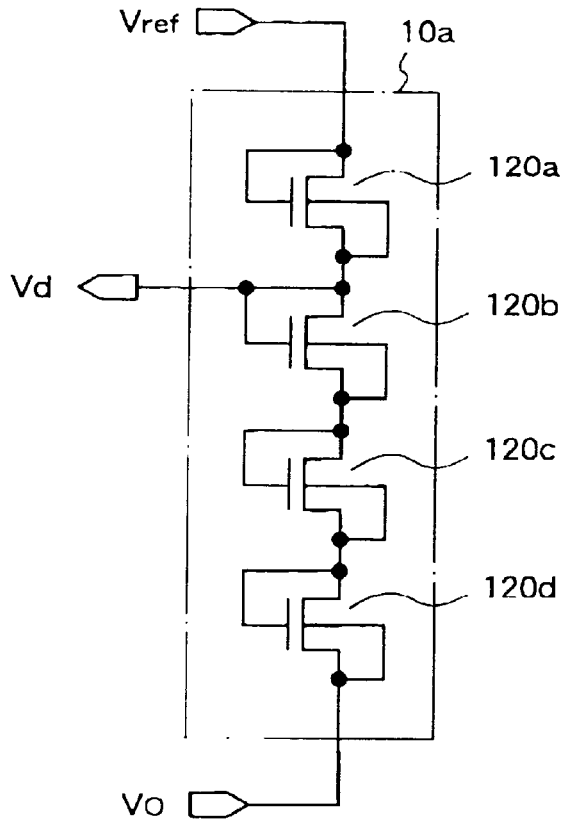
FIG. 18 is a circuit diagram illustrating another example of a voltage divider according to the third embodiment.
Figure 19:
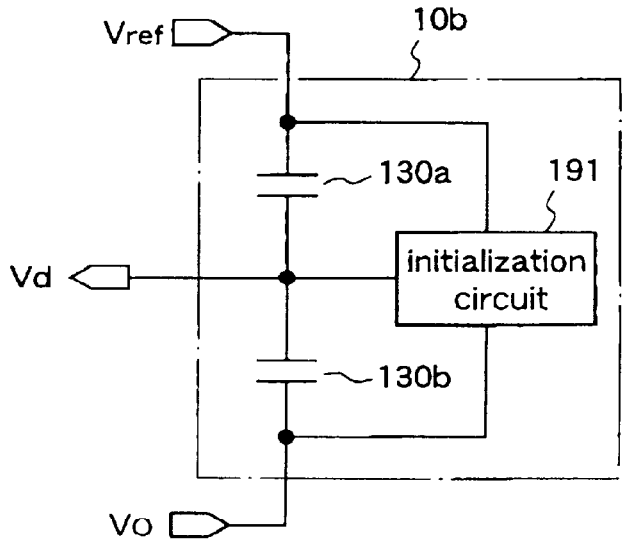
FIG. 19 is a circuit diagram illustrating still another example of a voltage divider according to the third embodiment.

FIGS. 18 and 19 are circuit diagrams illustrating voltage dividers 10*a* and 10*b* which are applicable to the semiconductor IC of this third embodiment.

The voltage divider 10*a* shown in FIG. 18 comprises diode-junction N type MOS transistors 120*a* to 120*d* which are connected in series between the output terminal of the reference voltage generator 3 and the output terminal of the output circuit 9, each transistor having a gate and a drain connected to each other, and a source connected to a substrate. In this case, the divided voltage Vd obtained in the voltage divider 10*a* is output from an output terminal which is connected to any of the nodes between the N type MOS transistors 120*a* to 120*d*. In place of the N type MOS transistors 120*a* to 120*d*, diode-junction P type MOS transistors may be employed.

Further, the voltage divider 10*b* shown in FIG. 19 comprises capacitors 130*a* and 130*b* which are connected in series between the output terminal of the reference voltage generator 3 and the output terminal of the output circuit 9, an initialization circuit 191 which performs initialization by short-circuiting the both ends of each capacitor, and an output terminal connected to a node between the capacitors 130*a* and 130*b*, from which the divided voltage Vd is taken out.

While in this third embodiment the voltage dividers 10, 10*a*, and 10*b* shown in FIGS. 14, 18, and 19 are described, the voltage divider of the present invention is not restricted thereto. Any voltage divider may be employed so long as it can operate in like manner as described for these voltage dividers.

[Embodiment 4]

Hereinafter, a semiconductor IC according to a fourth embodiment will be described with reference to the drawings.

Figure 20:
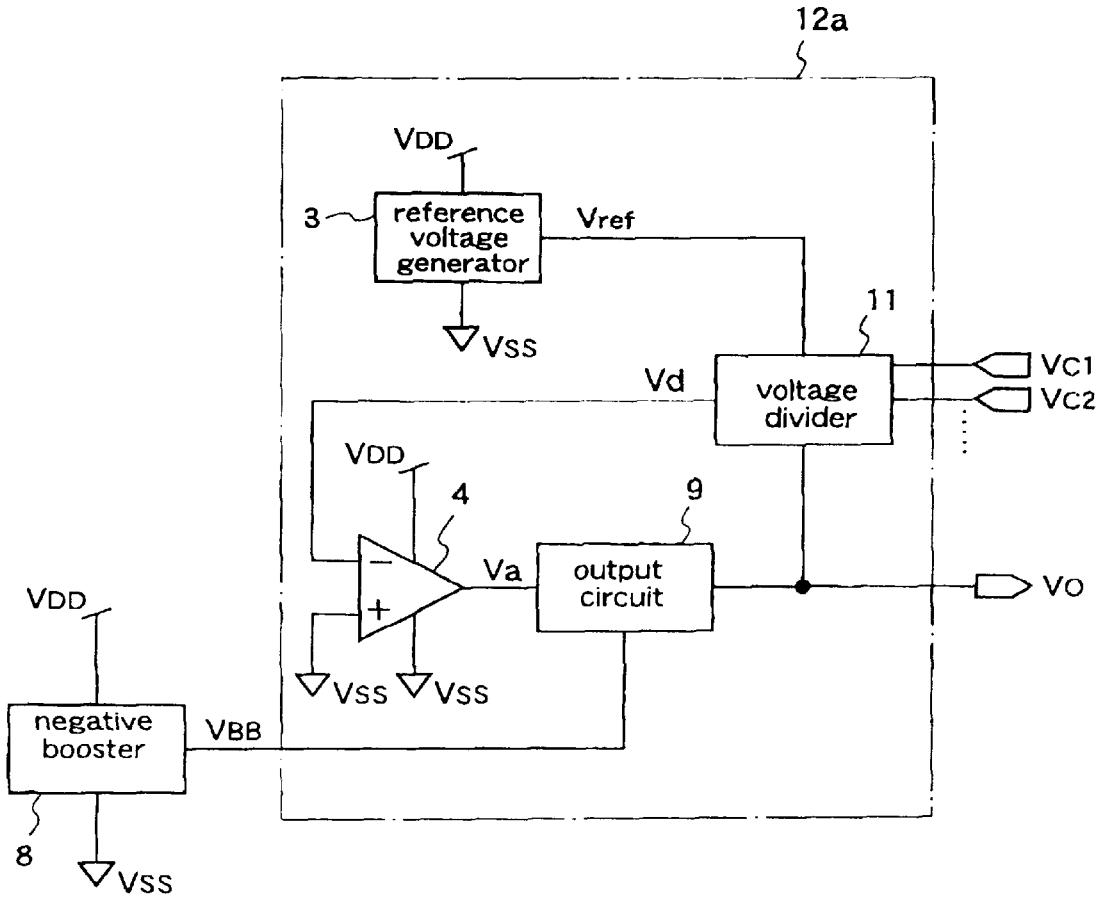
FIG. 20 is a block diagram illustrating a semiconductor IC according to a fourth embodiment of the present invention.

FIG. 20 is a block diagram illustrating a semiconductor IC according to the fourth embodiment.

In FIG. 20, the same reference numerals as those shown in FIG. 13 designate the same or corresponding parts. The semiconductor IC of this fourth embodiment is different from the semiconductor IC of the third embodiment only in that a regulator 12*a* includes a voltage divider 11 which can change the voltage ratio according to control signals $V_{C1}$ and $V_{C2}$.

Figure 21:
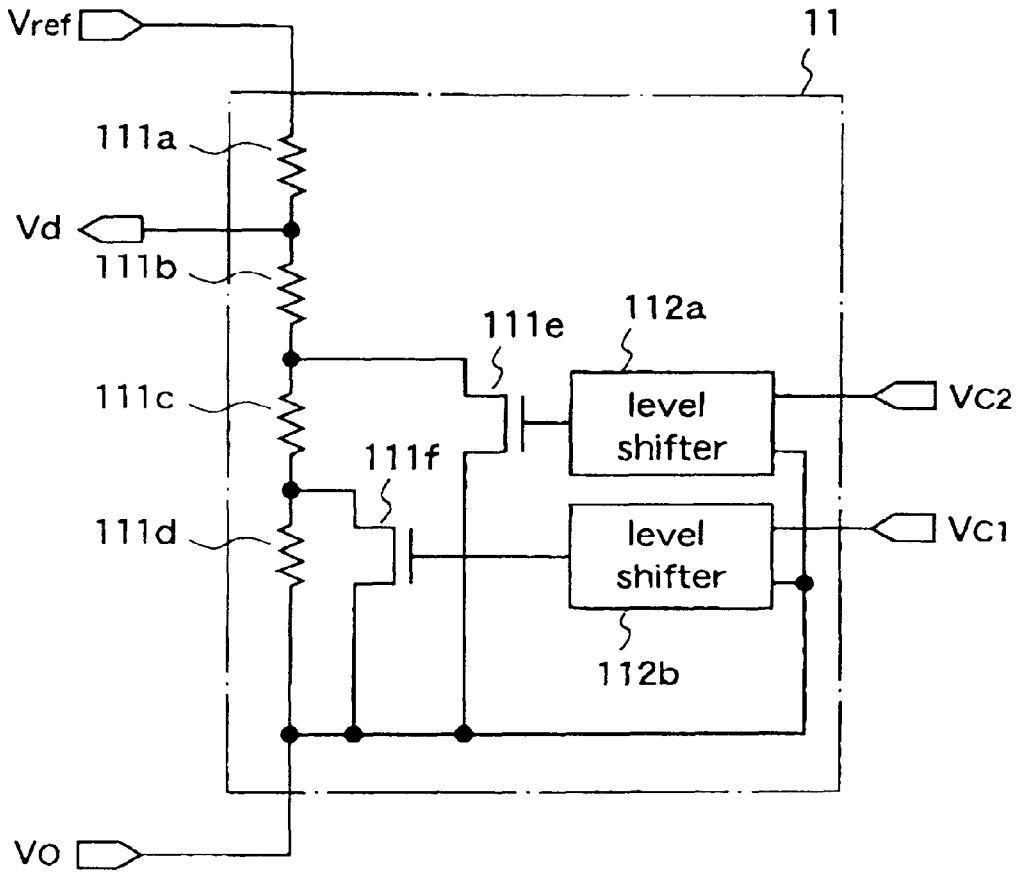
FIG. 21 is a circuit diagram illustrating an example of a voltage divider according to the fourth embodiment.

FIG. 21 is a circuit diagram illustrating a voltage divider 11 according to this fourth embodiment.

With reference to FIG. 21, the voltage divider 11 comprises a plurality of resistors 111*a* to 111*d* which are connected in series between the output terminal of the reference voltage generator 3 and the output terminal of the output circuit 9, level shifters 112*a* and 112*b*, N type MOS transistors 111*e* and 111*f* for voltage control, and an output terminal for outputting a divided voltage Vd. The level shifters 112*a* and 112*b* are supplied with the output voltage Vo from the regulator 12*a*, and the control signals VC1 and VC2 from the outside, respectively. The N type MOS transistor 111*e* for voltage control has a source as a control terminal to which the output voltage Vo from the output circuit 9 is applied, a drain connected to a node between the resistors 111*b* and 111*c*, and a gate to which the output from the level shifter 112*a* is applied. The N type MOS transistor 111*f* for voltage control has a source to which the output voltage Vo from the output circuit 9 is applied, a drain connected to a node between the resistors 111*c* and 111*d*, and a gate as a control terminal to which the output from the level shifter 112*b* is applied. The output terminal for outputting the divided voltage Vd is connected to a node between the resistors 111*a* and 111*b*. In the level shifters 112*a* and 112*b*, the control signals $V_{C1}$ and $V_{C2}$, each having a H level of $V_{DD}$ and a L level of $V_{SS}$, are level-shifted such that the H level and the L level become $V_{DD}$ and Vo, respectively. In this way, the level shifters 112*a* and 112*b* are used as control circuits for outputting control voltages based on the control signals $V_{C1}$ and $V_{C2}$, respectively. In the voltage divider 11, the N type MOS transistors 111*e* and 111*f* are turned on or off by inputting the control signals $V_{C1}$ and $V_{C2}$ to the level shifters 112*a* and 112*b*, respectively, and thus the resistance ratio is changed, whereby the voltage ratio r of the divided voltage Vd can be changed.

Next, the operation of the semiconductor IC according to this fourth embodiment will be described. The constituents of the IC other than the voltage divider 11 operate in the same way as described for the third embodiment and, therefore, repeated description is not necessary.

The voltage divider 11 outputs a divided voltage Vd which is obtained by dividing a potential difference between the output voltage Vo from the regulator 12*a* and the reference voltage Vref, according to the voltage ratio r which depends on the control signals $V_{C1}$ and $V_{C2}$, so as to satisfy the relationship (Vd−Vo)/(Vref−Vd)=r. Then, the voltage divider 11 changes the control signals $V_{C1}$ and $V_{C2}$ to change the voltage ratio r, thereby controlling the divided voltage vd.

As described above, since the semiconductor IC according to this fourth embodiment is provided with the voltage divider 11 which can change the voltage ratio r according to the control signals $V_{C1}$ and $V_{C2}$, the output voltage Vo from the regulator 12*a* can be changed by changing the control signals $V_{C1}$ and $V_{C2}$, without changing the reference voltage Vref as in the conventional semiconductor IC. Hence, different negative voltages Vo to be used in different operation modes of a nonvolatile semiconductor memory device, such as erasing, writing, etc., can be generated using one positive reference voltage Vref. Therefore, the reference voltage generator 3 does not need to generate plural reference voltages Vref, and thus the reference voltage generator 3 is simplified and reduced in scale. As the result, the area of the semiconductor IC is further reduced.

While in this fourth embodiment the voltage divider 11 shown in FIG. 21 is described, this is only one example, and other voltage dividers may be employed.

For example, although the voltage divider 11 includes four resistors connected in series, the number of resistors may be other than four. Also in this case, the drain of each of the transistors 111*e* and 111*f* is connected to any of the nodes between these resistors, and an output terminal for taking out the divided voltage Vd is connected to any of the nodes between these resistors.

Further, although the voltage divider 11 includes two transistors for voltage control, the number of transistors for voltage control may be one or more than two.

Figure 22:
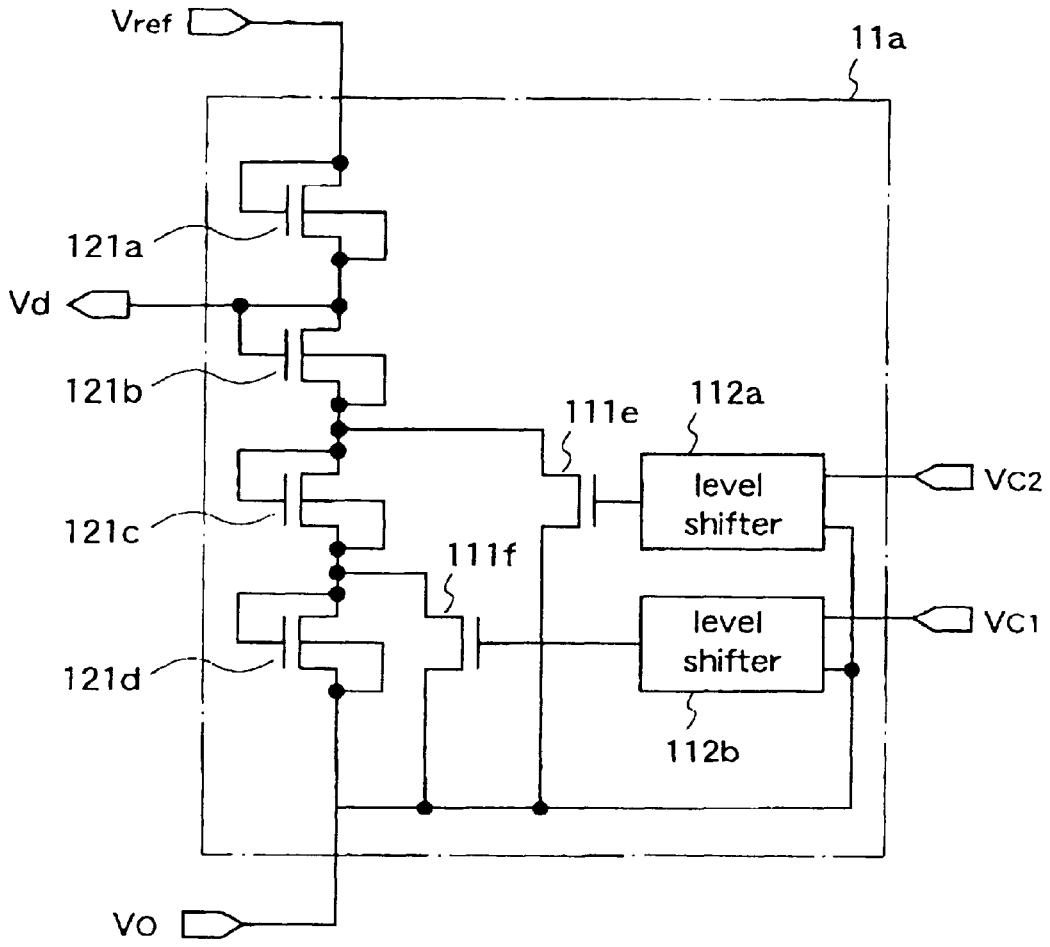
FIG. 22 is a circuit diagram illustrating another example of a voltage divider according to the fourth embodiment.
Figure 23:
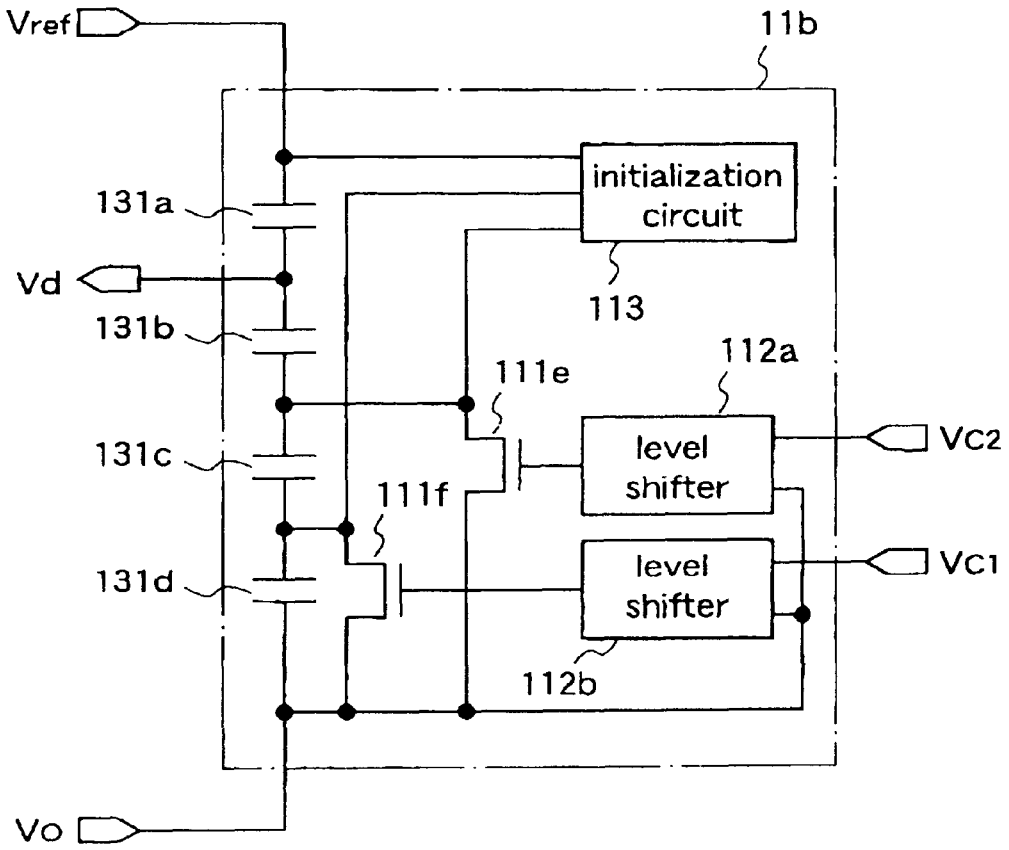
FIG. 23 is a circuit diagram illustrating still another example of a voltage divider according to the fourth embodiment.
Figure 24:
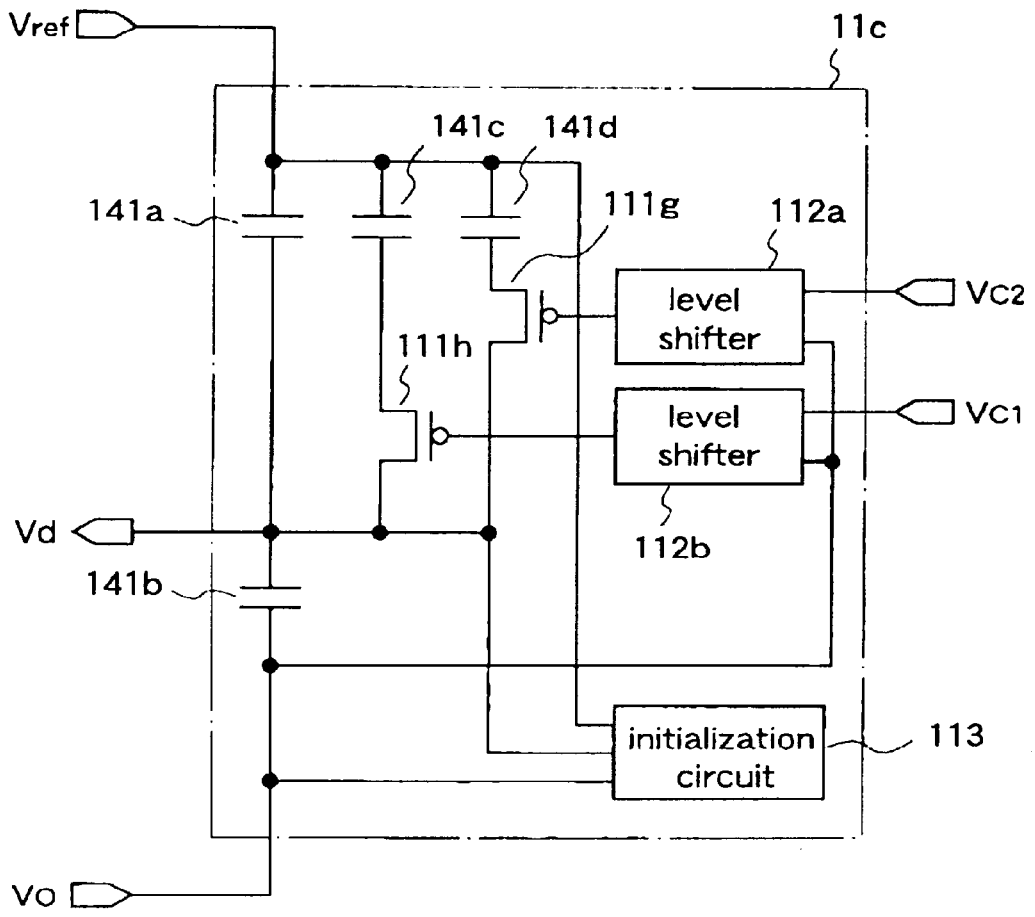
FIG. 24 is a circuit diagram illustrating a further example of a voltage divider according to the fourth embodiment.

FIGS. 22 to 24 are circuit diagrams illustrating voltage dividers 11*a*, 11*b*, and 11*c* which are applicable to the semiconductor IC of this fourth embodiment.

The voltage divider 11*a* shown in FIG. 22 comprises a plurality of N type MOS transistors 121*a* to 121*d* which are connected in series between the output terminal of the reference voltage generator 3 and the output terminal of the output circuit 9, level shifters 112*a* and 112*b*, N type MOS transistors 111*e* and 111*f* for voltage control, and an output terminal for outputting the divided voltage Vd.

To be specific, each of the N type MOS transistors 121*a* to 121*d* is a diode-junction MOS transistor having a gate and a drain connected to each other, and a source connected to a substrate. The level shifters 112*a* and 112*b* and the N type MOS transistors 111*e* and 111*f* are identical to those of the voltage divider 11 shown in FIG. 21 and, therefore, do not require repeated description. The output terminal for outputting the divided voltage Vd is connected to a node between the transistors 121*a* and 121*b*.

In the voltage divider 11*a*, as in the voltage divider 11, the voltage ratio r of the divided voltage Vd can be changed by turning on or off the N type MOS transistors 117*e* and 117*f* according to the control signals $V_{C1}$ and $V_{C2}$.

By the way, in the voltage divider 11, a high resistance is required for reducing the current that flows from the output terminal of the regulator 12*a* through the resistors, and this is disadvantageous in respect to the area. On the other hand, in the voltage divider 11*a*, the current that flows in the voltage divider 11*a* can be minimized by using the N type MOS transistors 121*a* to 121*d* of the same characteristics and setting the reference voltage Vref at a level a little higher than the threshold voltage of these N type MOS transistors, as in the case of the voltage divider 7*a* according to the second embodiment. Therefore, the scale of the negative booster 8 can be minimized, and the circuit scale of the semiconductor IC as a whole can be further reduced as compared with the case of using the voltage divider 11 including the resistors. In place of the N type MOS transistors 121*a* to 121*d*, diode-junction P type MOS transistors may be used.

Further, the voltage divider 11*b* shown in FIG. 23 comprises a plurality of capacitors 131*a* to 131*d* connected in series between the output terminal of the reference voltage generator 3 and the output terminal of the output circuit 9, an initialization circuit 113, level shifters 112*a* and 112*b*, N type MOS transistors 111*e* and 111*f* for voltage control, and an output terminal for outputting a divided voltage Vd.

The initialization circuit 113 performs initialization by short-circuiting the both ends of each of the capacitors 131*a* to 131*d*. The level shifters 112*a* and 112*b* and the N type MOS transistors 111*e* and 111*f* are identical to those of the voltage divider 11 shown in FIG. 21 and, therefore, do not require repeated description. The output terminal for the divided voltage Vd is connected to a node between the capacitors 131*a* and 131*b*.

In the voltage divider 11*b*, as in the voltage divider 11, the level shifters 112*a* and 112*b* decide ON or OFF of the N type MOS transistors 111*e* and 111*f* according to the control signals $V_{C1}$ and $V_{C2}$ and, thereafter, the initialization circuit 113 initializes the capacitors 131*a* to 131*d* by short-circuiting the both ends of each capacitor, whereby the voltage ratio r of the divided voltage Vd can be changed according to the control signals $V_{C1}$ and $V_{C2}$. In comparison with the voltage dividers 11 and 11*a*, the voltage divider 11*b* needs to initialize the capacitors, but the current that flows in the voltage divider 11*b* is significantly reduced because the output from the regulator 12*a* has no dc component.

Further, the voltage divider 11*c* shown in FIG. 24 comprises capacitors 141*a* and 141*b* connected in series between the output terminal of the reference voltage generator 3 and the output terminal of the output circuit 9, capacitors 141*c* and 141*d* each having an end to which the reference voltage Vref is applied, the level shifters 112*a* and 112*b*, P type MOS transistors 111*g* and 111*h* for voltage control, an initialization circuit 113, and an output terminal for outputting a divided voltage Vd.

The P type MOS transistor 111*g* has a gate connected to the output of the level shifter 112*a*, a drain connected to a node between the capacitors 141*a* and 141*b*, and a source connected to the capacitor 141*d*. The P type MOS transistor 111*h* has a gate connected to the output of the level shifter 112*b*, a drain connected to a node between the capacitors 141*a* and 141*b*, and a source connected to the capacitor 141*c*. The initialization circuit 113 performs initialization by short-circuiting the both ends of each of the capacitors 141*a* to 141*d*. The level shifters 112*a* and 112*b* are identical to those of the voltage divider 11 shown in FIG. 21 and, therefore, do not require repeated description. The output terminal for the divided voltage Vd is connected to a node between the capacitors 141*a* and 141*b*.

In the voltage divider 11*c*, as in the voltage divider 11, the level shifters 112*a* and 112*b* decide ON or OFF of the N type MOS transistors 111*g* and 111*h* according to the control signals $V_{C1}$ and $V_{C2}$ and, thereafter, the capacitors 141*a* to 141*d* are initialized by the initialization circuit 113, whereby the voltage ratio r of the divided voltage Vd can be changed according to the control signals $V_{C1}$ and $V_{C2}$. Also in the voltage divider 11*c*, as in the voltage divider 11, the current from the output terminal of the regulator 12*a* is significantly reduced.

While in this fourth embodiment the voltage dividers 11, 11*a*, 11*b*, and 11*c* shown in FIGS. 21 to 24 are described, the voltage divider of the present invention is not restricted thereto. Any voltage divider may be used so long as it can operate in like manner as described for these voltage dividers.

[Embodiment 5]

Hereinafter, a semiconductor IC according to a fifth embodiment of the present invention will be described with reference to the drawings.

Figure 25:
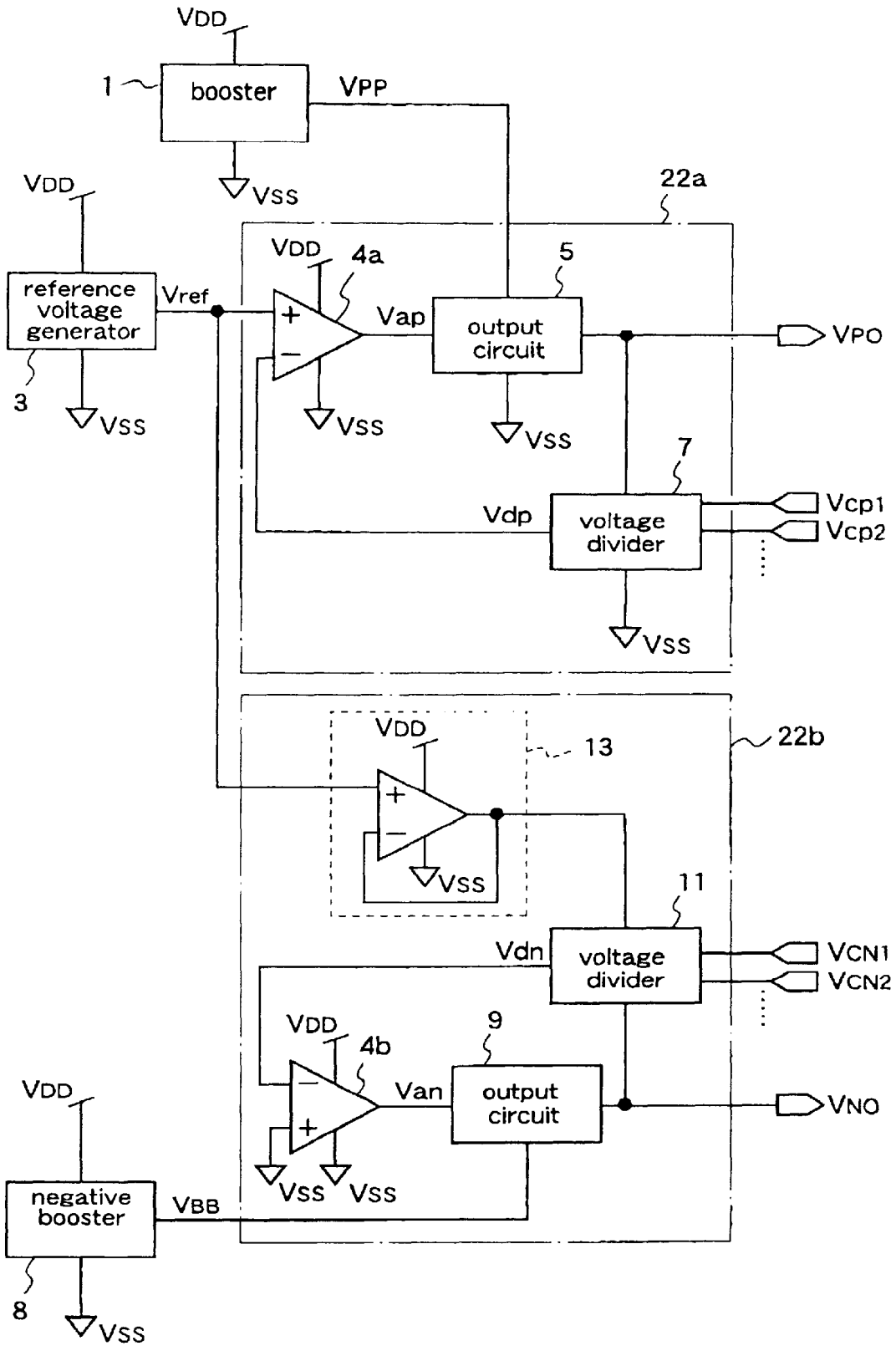
FIG. 25 is a block diagram illustrating a semiconductor IC according to a fifth embodiment of the present invention.
Figure 26:
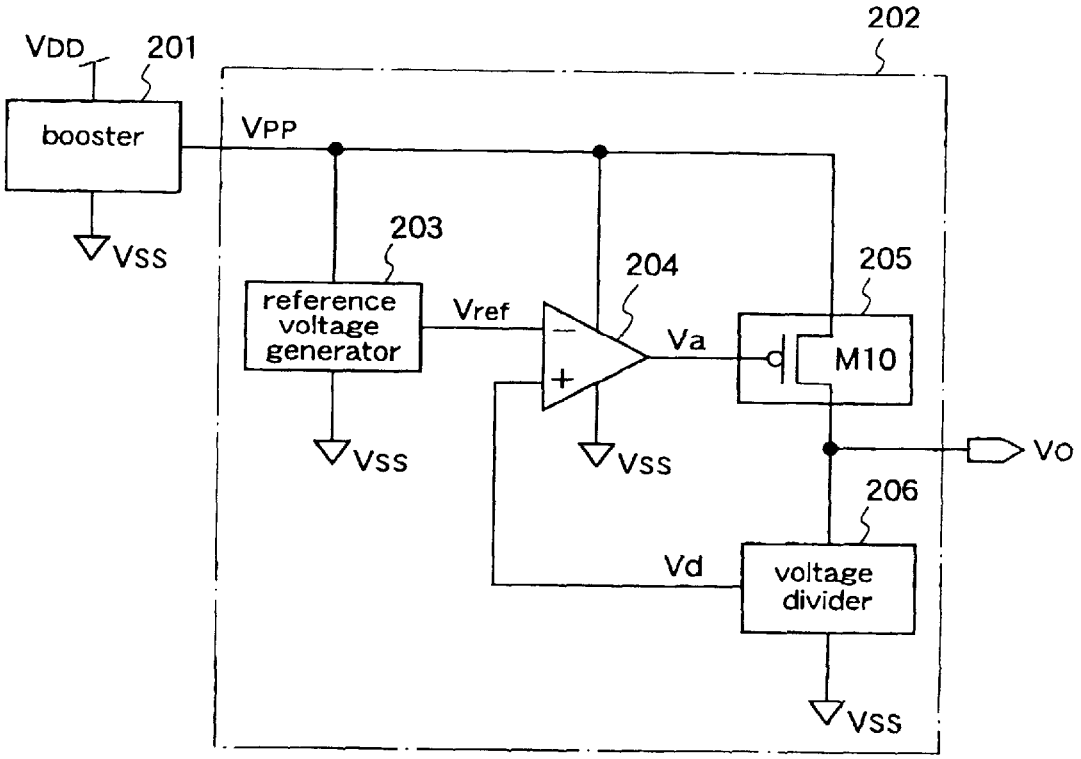
Fig.26 Prior Art
FIG. 26 is a block diagram illustrating a conventional semiconductor IC.
Figure 27:
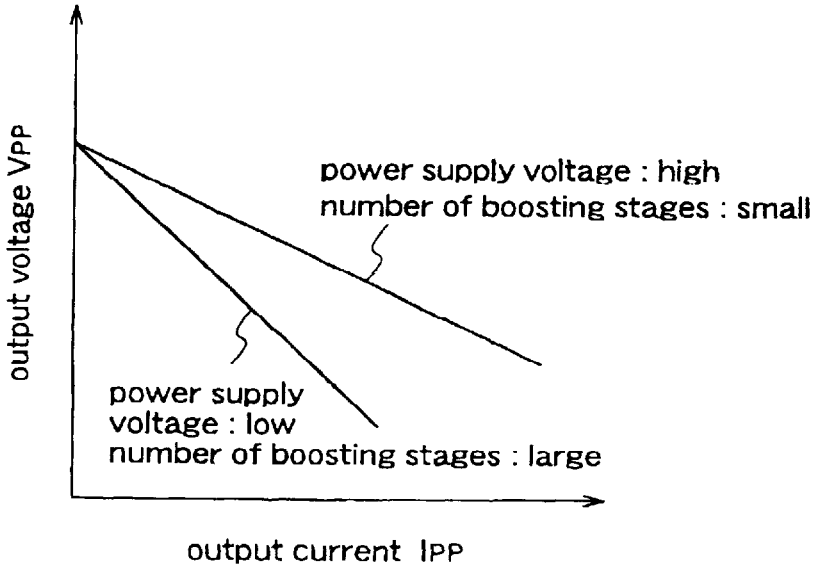
Fig.27 Prior Art
FIG. 27 is a diagram illustrating the relationship between an output current and an output voltage from a booster.

FIG. 25 is a block diagram illustrating a semiconductor IC according to the fifth embodiment.

In FIG. 25, the semiconductor IC comprises a booster 1, a reference voltage generator 3, a negative booster 8, a positive regulator 22*a*, and a negative regulator 22*b*. The booster 1 boosts the power supply voltage $V_{DD}$ applied to the semiconductor IC to a predetermined voltage $V_{PP}$. The reference voltage generator 3 is supplied with the power supply voltage $V_{DD}$, generates a predetermined reference voltage Vref, and outputs it. The negative booster 8 generates a predetermined negative voltage $V_{BB}$ from the power supply voltage $V_{DD}$. The positive regulator 22*a* is supplied with the boosted voltage $V_{PP}$, and outputs an output voltage $V_{PO}$. The negative regulator 22*b* is supplied with the negative voltage $V_{BB}$, and generates an output voltage $V_{NO}$. The positive regulator 22*a* comprises a differential amplifier 4*a*, an output circuit 5, and a voltage divider 7. The negative regulator 22*b* comprises a differential amplifier 4*b*, an output circuit 9, a voltage divider 11, and a voltage follower circuit 13. In FIG. 25, the same reference numerals as those shown in FIGS. 8 and 20 designate the same or corresponding parts.

The voltage follower circuit 13 comprises a differential amplifier which supplies a reference voltage Vref through a voltage follower to the voltage divider 11. Usually, in the negative regulator 22*b*, the output impedance of the reference voltage generator 3 is high. In this fifth embodiment, however, the output impedance of the reference voltage generator 3 is reduced by the voltage follower circuit 13.

Next, the operation of the semiconductor IC according to this fifth embodiment will be described.

The reference voltage generator 3 generates a predetermined reference voltage Vref from the power supply voltage $V_{DD}$, and outputs it to the positive regulator 22*a* and the negative regulator 22*b*. The reference voltage Vref applied to the negative regulator 22*b* is input to the voltage divider 11. through the voltage follower circuit 13. The operation of the semiconductor IC other than described above is identical to that described for the second and fourth embodiments and, therefore, repeated description is not necessary.

As described above, the semiconductor IC according to this fifth embodiment is provided with the positive regulator 22*a* and the negative regulator 22*b* which are integrated on the same substrate, and these regulators 22*a* and 22*b* are operated by the same positive reference voltage. Therefore, these regulators 22*a* and 22*b* can share the reference voltage generator 3, whereby the circuit scale is reduced as compared with the case where the positive regulator and the negative regulator are provided with the respective reference voltage generators. As the result, the area of the semiconductor IC is further reduced.

Although the output circuits 5, 5*a*, and 5*b* shown in FIGS. 3 to 5 are described as the output circuit of this fifth embodiment, the output circuit is not restricted thereto. Further, although the voltage dividers 7, 7*a*, 7*b*, and 7*c* are described as the voltage divider of this fifth embodiment, the voltage divider is not restricted thereto.

Further, although the output circuits 9, 9*a*, and 9*b* shown in FIGS. 15 to 17 are described as the output circuit of this fifth embodiment, the output circuit is not restricted thereto. Further, although the voltage dividers 11, 11*a*, 11*b*, and 11*c* shown in FIGS. 21 to 24 are described as the voltage divider of this fifth embodiment, the voltage divider is not restricted thereto.

What is claimed is:

1. A semiconductor integrated circuit comprising:

a booster for boosting a power supply voltage, and outputting the boosted voltage;

an output circuit being supplied with the boosted voltage, generating an output voltage from the boosted voltage, and outputting the output voltage through an output terminal;

a reference voltage generator being supplied with the power supply voltage, generating a reference voltage from the power supply voltage, and outputting the reference voltage;

a voltage divider being supplied with the output voltage from the output circuit, dividing the output voltage with a predetermined voltage ratio, and outputting the divided voltage; and a differential amplifier being supplied with the reference voltage and the divided voltage, and controlling the output circuit by supplying the output circuit with a voltage which is obtained by performing differential amplification on the reference voltage and the divided voltage according to the power supply voltage, thereby maintaining the output voltage from the output circuit at a predetermined voltage.

2. The semiconductor integrated circuit of claim 1 wherein said voltage divider is a resistance type voltage divider having a plurality of resistors connected in series.

3. The semiconductor integrated circuit of claim 1 wherein said voltage divider comprises a plurality of diode-junction type transistors connected in series, each transistor having a gate and a drain connected to each other, and a source connected to a substrate.

4. The semiconductor integrated circuit of claim 1 wherein said voltage divider comprises:

a plurality of capacitors connected in series; and an initialization circuit performing initialization by short-circuiting the both ends of each capacitor.

5. The semiconductor integrated circuit of claim 1 wherein said voltage divider sets the voltage ratio at different values according to control signals.

6. The semiconductor integrated circuit of claim 5 wherein said voltage divider comprises:

a plurality of resistors connected in series between the output terminal of the output circuit and the ground voltage;

at least one transistor having an end connected to any of the nodes between the plural resistors, and the other end connected to the output terminal of the output circuit;

a control circuit being supplied with the control signal, and giving a control voltage based on the control signal to a control end of the transistor; and an output terminal for taking out the divided voltage, connected to any of the nodes between the plural resistors.

7. The semiconductor integrated circuit of claim 5 wherein said voltage divider comprises:

a plurality of diode-junction type transistors connected in series between the output terminal of the output circuit and the ground voltage, each transistor having a gate and a drain connected to each other, and a source connected to a substrate;

at least one transistor for voltage control, having an end connected to any of the nodes between the plural transistors, and the other end connected to the output terminal of the output circuit;

a control circuit being supplied with the control signal, and giving a control voltage based on the control signal to a control end of the transistor for voltage control; and an output terminal for taking out the divided voltage, connected to any of the nodes between the plural transistors.

8. The semiconductor integrated circuit of claim 5 wherein said voltage divider comprises:

a plurality of capacitors connected in series between the output terminal of the output circuit and the ground voltage;

at least one transistor having an end connected to any of the nodes between the plural capacitors, and the other end connected to the output terminal of the output circuit;

a control circuit being supplied with the control signal, and giving a control voltage based on the control signal to a control end of the transistor;

an initialization circuit performing initialization by short-circuiting the both ends of each capacitor; and an output terminal for taking out the divided voltage, connected to any of the nodes between the plural capacitors.

9. The semiconductor integrated circuit of claim 5 wherein said voltage divider comprises:

two first capacitors connected in series between the output terminal of the output circuit and the ground voltage;

at least one transistor having an end connected to a node between the first capacitors;

at least one second capacitor, as many as said transistor, having an end connected to the transistor, and the other end being grounded;

a control circuit being supplied with the control signal, and giving a control voltage based on the control signal to a control end of the transistor;

an initialization circuit for initializing the node between the first capacitors; and an output terminal for taking out the divided voltage, connected to the node between the first capacitors.

10. The semiconductor integrated circuit of claim 1 wherein said output circuit comprises:

a first P type MOS transistor having a gate, a source connected to the output terminal of the booster, and a drain connected to the output terminal of the output circuit;

a second P type MOS transistor having a gate, a source connected to the output terminal of the booster, and a drain connected to the gate of the first P type MOS transistor;

an N type MOS transistor having a source being grounded, a drain connected to the drain of the second P type MOS transistor, and a gate connected to the output terminal of the differential amplifier; and a bias circuit for giving a bias voltage to the gate of the second P type MOS transistor.

11. The semiconductor integrated circuit of claim 1 wherein said output circuit comprises:

a first P type MOS transistor having a gate, a source connected to the output terminal of the booster, and a drain connected to the output terminal of the output circuit;

a second P type MOS transistor having a source connected to the output terminal of the booster, and a gate and a drain connected to the gate of the first P type MOS transistor; and an N type MOS transistor having a source being grounded, a drain connected to the drain of the second P type MOS transistor, and a gate connected to the output terminal of the differential amplifier.

12. The semiconductor integrated circuit of claim 1 wherein said output circuit comprises:

a first P type MOS transistor having a gate, a source connected to the output terminal of the booster, and a drain connected to the output terminal of the output circuit;

a second P type MOS transistor having a source connected to the output terminal of the booster, a drain connected to the gate of the first P type MOS transistor, and a gate being grounded; and an N type MOS transistor having a source being grounded, a drain connected to the drain of the second P type MOS transistor, and a gate connected to the output terminal of the differential amplifier.

13. A semiconductor integrated circuit comprising:

a negative booster for generating a negative voltage from a power supply voltage, and outputting the negative voltage;

an output circuit being supplied with the negative voltage, generating an output voltage from the negative voltage, and outputting the output voltage through an output terminal;

a reference voltage generator being supplied with the power supply voltage, generating a reference voltage from the power supply voltage, and outputting the reference voltage;

a voltage divider being supplied with the output voltage from the output circuit and the reference voltage, dividing a potential difference between the output voltage and the reference voltage according to a predetermined voltage ratio, and outputting the divided voltage; and a differential amplifier being supplied with the divided voltage and a ground voltage, and controlling the output circuit by supplying the output circuit with a voltage which is obtained by performing differential amplification on the divided voltage and the ground voltage according to the power supply voltage, thereby maintaining the output voltage from the output circuit at a predetermined voltage.

14. The semiconductor integrated circuit of claim 13 wherein said voltage divider is a resistance type voltage divider having a plurality of resistors connected in series.

15. The semiconductor integrated circuit of claim 13 wherein said voltage divider comprises a plurality of diode-junction type transistors connected in series, each transistor having a gate and a drain connected to each other, and a source connected to a substrate.

16. The semiconductor integrated circuit of claim 13 wherein said voltage divider comprises:

a plurality of capacitors connected in series; and an initialization circuit performing initialization by short-circuiting the both ends of each capacitor.

17. The semiconductor integrated circuit of claim 13 wherein said voltage divider sets the voltage ratio at different values according to control signals.

18. The semiconductor integrated circuit of claim 17 wherein said voltage divider comprises:

a plurality of resistors connected in series between the output terminal of the output circuit and the output terminal of the reference voltage generator;

at least one transistor having an end connected to any of the nodes between the plural resistors, and the other end connected to the output terminal of the output circuit;

a control circuit being supplied with the control signal, and giving a control voltage based on the control signal to a control end of the transistor; and an output terminal for taking out the divided voltage, connected to any of the nodes between the plural resistors.

19. The semiconductor integrated circuit of claim 17 wherein said voltage divider comprises:

a plurality of diode-junction type transistors connected in series between the output end of the output circuit and the output end of the reference voltage generator, each transistor having a gate and a drain connected to each other, and a source connected to a substrate;

at least one transistor for voltage control having an end connected to any of the nodes between the plural transistors, and the other end connected to the output end of the output circuit;

a control circuit being supplied with the control signal, and giving a control voltage based on the control signal to a control end of the transistor for voltage control; and an output terminal for taking out a divided voltage, connected to any of the nodes between the plural transistors.

20. The semiconductor integrated circuit of claim 17 wherein said voltage divider comprises:

a plurality of capacitors connected in series between the output terminal of the output circuit and the output terminal of the reference voltage generator;

at least one transistor having an end connected to any of the nodes between the plural capacitors, and the other end connected to the output terminal of the output circuit;

a control circuit being supplied with the control signal, and giving a control voltage based on the control signal to a control end of the transistor;

an initialization circuit performing initialization by short-circuiting the both ends of each capacitor; and an output terminal for taking out the divided voltage, connected to any of the nodes between the plural capacitors.

21. The semiconductor integrated circuit of claim 17 wherein said voltage divider comprises:

two first capacitors connected in series between the output terminal of the output circuit and the output terminal of the reference voltage generator;

at least one transistor having an end connected to a node between the first capacitors;

at least one second capacitor, as many as said transistor, having an end connected to the transistor, and the other end connected to the output terminal of the reference voltage generator;

a control circuit being supplied with the control signal, and giving a control voltage based on the control signal to a control end of the transistor;

an initialization circuit for initializing the node between the first capacitors; and an output terminal for taking out the divided voltage, connected to the node between the first capacitors.

22. The semiconductor integrated circuit of claim 13 wherein said output circuit comprises:

a first N type MOS transistor having a gate, a source connected to the output terminal of the negative booster, and a drain connected to the output terminal of the output circuit;

a second N type MOS transistor having a gate, a source connected to the output terminal of the negative booster, and a drain connected to the gate of the first N type MOS transistor;

a P type MOS transistor having a source connected to the power supply voltage, a drain connected to the drain of the second N type MOS transistor, and a gate connected to the output terminal of the differential amplifier; and a bias circuit for giving a bias voltage to the gate of the second N type MOS transistor.

23. The semiconductor integrated circuit of claim 13 wherein said output circuit comprises:

a first N type MOS transistor having a gate, a source connected to the output terminal of the negative booster, and a drain connected to the output terminal of the output circuit;

a second N type MOS transistor having a source connected to the output terminal of the negative booster, and a gate and a drain connected to the gate of the first N type MOS transistor; and a P type MOS transistor having a source connected to the power supply voltage, a drain connected to the drain of the second N type MOS transistor, and a gate connected to the output terminal of the differential amplifier.

24. The semiconductor integrated circuit of claim 13 wherein said output circuit comprises:

a first N type MOS transistor having a gate, a source connected to the output terminal of the negative booster, and a drain connected to the output terminal of the output circuit;

a second N type MOS transistor having a source connected to the output terminal of the negative booster, a drain connected to the gate of the first N type MOS transistor, and a gate being grounded; and a P type MOS transistor having a source connected to the power supply voltage, a drain connected to the drain of the second N type Mos transistor, and a gate connected to the output terminal of the differential amplifier.

25. A semiconductor integrated circuit comprising:

a booster for boosting a power supply voltage, and outputting the boosted voltage;

a first output circuit being supplied with the boosted voltage, generating an output voltage from the boosted voltage, and outputting the output voltage through an output terminal;

a reference voltage generator being supplied with the power supply voltage, generating a reference voltage from the power supply voltage, and outputting the reference voltage;

a first voltage divider being supplied with the output voltage from the first output circuit, dividing the output voltage according to a predetermined voltage ratio, and outputting the divided voltage;

a first differential amplifier being supplied with the reference voltage and the divided voltage from the first voltage divider, and controlling the first output circuit by supplying it with a voltage which is obtained by performing differential amplification on the reference voltage and the divided voltage according to the power supply voltage, thereby maintaining the output voltage from the first output circuit at a predetermined voltage;

a negative booster for generating a negative voltage from the power supply voltage, and outputting the negative voltage;

a second output circuit being supplied with the negative voltage, generating an output voltage from the negative voltage, and outputting the output voltage through an output terminal;

a second voltage divider being supplied with the output voltage from the second output circuit and the reference voltage, dividing a potential difference between the output voltage and the reference voltage according to a predetermined voltage ratio, and outputting the divided voltage; and a second differential amplifier being supplied with the divided voltage from the second voltage divider and the ground voltage, and controlling the second output circuit by supplying it with a voltage which is obtained by performing differential amplification on the divided voltage and the reference voltage according to the power supply voltage, thereby maintaining the output voltage from the second output circuit at a predetermined voltage.

26. The semiconductor integrated circuit of claim 25 wherein said first voltage divider comprises:

a plurality of diode-junction type transistors connected in series between the output terminal of the first output circuit and the ground voltage, each transistor having a gate and a drain connected to each other, and a source connected to a substrate;

at least one transistor for voltage control having an end connected to any of the nodes between the plural transistors, and the other end connected to the output terminal of the first output circuit;

a control circuit being supplied with the control signal, and giving a control voltage based on the control -signal to a control end of the transistor for voltage control; and an output terminal for taking out the divided voltage, connected to any of the nodes between the plural transistors.

27. The semiconductor integrated circuit of claim 25 wherein said second voltage divider comprises:

a plurality of diode-junction type transistors connected in series between the output terminal of the second output circuit and the output terminal of the reference voltage generator, each transistor having a gate and a drain connected to each other, and a source connected to a substrate;

at least one transistor for voltage control having an end connected to any of the nodes between the plural transistors, and the other end connected to the output terminal of the second output circuit;

a control circuit being supplied with the control signal, and giving a control voltage based on the control signal to a control end of the transistor for voltage control; and an output terminal for taking out the divided voltage, connected to any of the nodes between the plural transistors.

28. The semiconductor integrated circuit of claim 25 further comprising:

a voltage follower circuit being supplied with the output from the reference voltage generator; and said second voltage divider being supplied with the output voltage from the voltage follower circuit, as the reference voltage, instead of the output from the reference voltage generator.

* * * * *